US006253786B1

(12) United States Patent
Maa

(10) Patent No.: US 6,253,786 B1
(45) Date of Patent: Jul. 3, 2001

(54) COUPLING DEVICES FOR RAILWAY CARS

(76) Inventor: Shalong Maa, 816 McDeavitt Dr. #1077, Arlington, TX (US) 76011

( * ) Notice: Subject to any disclaimer, the term of this patent is extended or adjusted under 35 U.S.C. 154(b) by 0 days.

(21) Appl. No.: 09/065,808

(22) Filed: Apr. 23, 1998

Related U.S. Application Data

(60) Provisional application No. 60/044,193, filed on Apr. 25, 1997, provisional application No. 60/054,031, filed on Jul. 28, 1997, provisional application No. 60/059,674, filed on Sep. 18, 1997, provisional application No. 60/061,006, filed on Oct. 6, 1997, and provisional application No. 60/076,288, filed on Feb. 27, 1998.

(51) Int. Cl.[7] ..... B61D 49/00

(52) U.S. Cl. ..... 137/349; 137/347; 137/614.04; 137/614.06; 105/355

(58) Field of Search ..... 137/347, 348, 137/349, 614.06, 614.04; 105/454, 355

(56) References Cited

U.S. PATENT DOCUMENTS

| | | | | |
|---|---|---|---|---|
| 442,621 | * | 12/1890 | Harris | 137/349 |
| 682,882 | * | 9/1901 | Ness | 137/349 |
| 895,617 | * | 8/1908 | Carlgren | 137/349 |
| 941,348 | * | 11/1909 | Campbell et al. | 137/349 |
| 1,190,063 | * | 7/1916 | Woods | 137/349 |
| 1,876,918 | * | 9/1932 | Gray et al. | 137/349 |
| 2,296,170 | * | 9/1942 | Lockhart | 137/349 |
| 5,480,042 | * | 1/1996 | Engle | 137/347 |

* cited by examiner

*Primary Examiner*—A. Michael Chambers
(74) *Attorney, Agent, or Firm*—SMA International, Inc.

(57) ABSTRACT

Disclosed herein is apparatus for installation on railroad cars and automatically connecting pneumatic and/or electric lines of two adjacent railroad cars. The principle of the product design is to apply pneumatic system's own pressure for automatically sealing the juncture area of the coupling and for sealing the hose end and maintaining air pressure at the compressor source when a train brake-in-two occurs. The preferred embodiment includes a substantially rectangular front-mating assembly attached to the front end of a rearwardly extending coupler shank and an installation portion for attaching said rectangular front-mating assembly to the undercarriage of a rail-car via said coupler shank. Said front-mating assembly includes a male and a female mating heads mounted on its front panel and a pair of alignment members installed at its two sides for guiding said mating heads to the appropriate coupling positions during the coupling. The coupling systems of the present invention are independent of and shall work in conjunction with the conventional standard coupler of a railroad car.

40 Claims, 20 Drawing Sheets

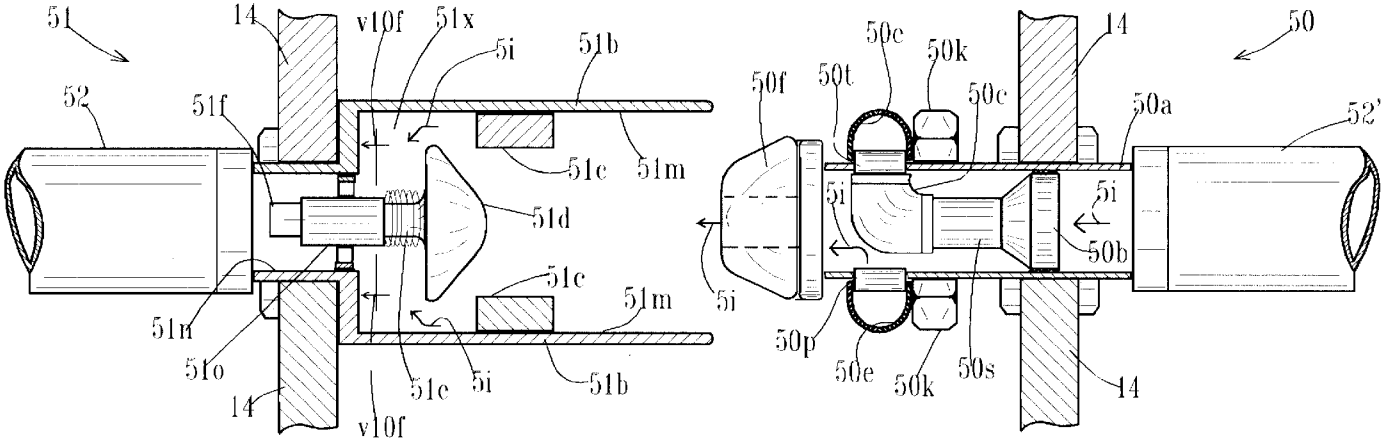
FIG. 8a
FIG. 9a
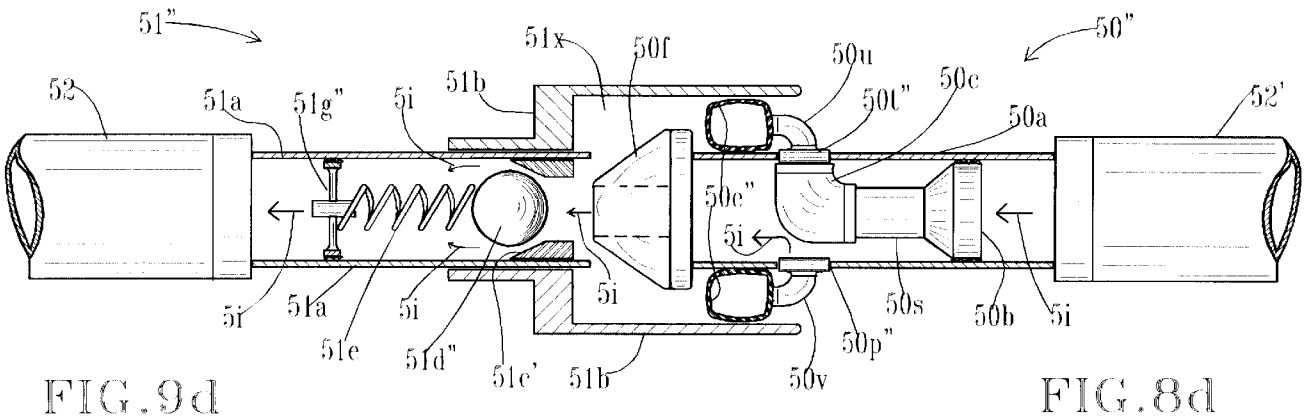
FIG. 8d
FIG. 9d

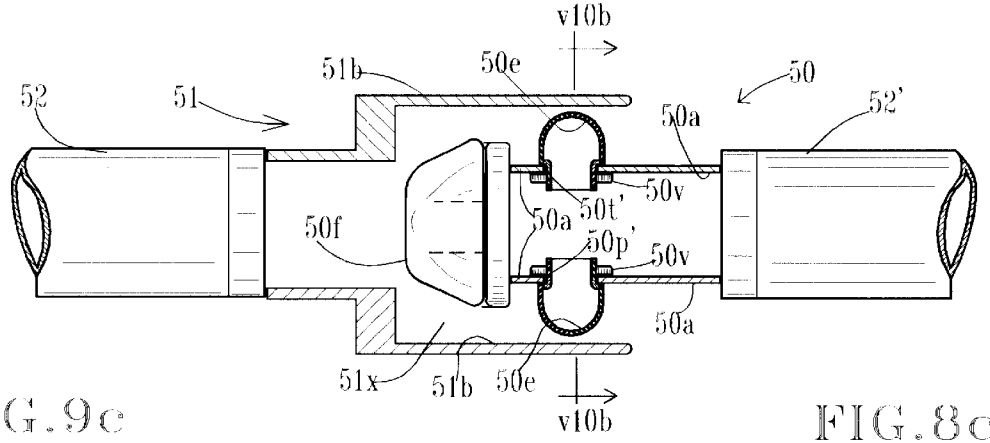
FIG. 8c
FIG. 9c
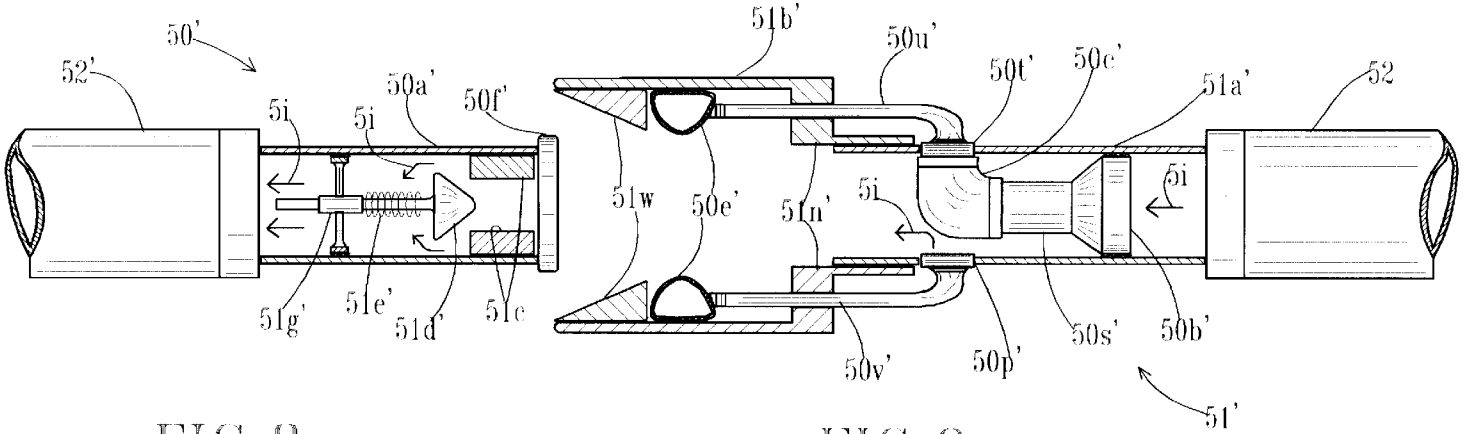
FIG. 9c
FIG. 8c

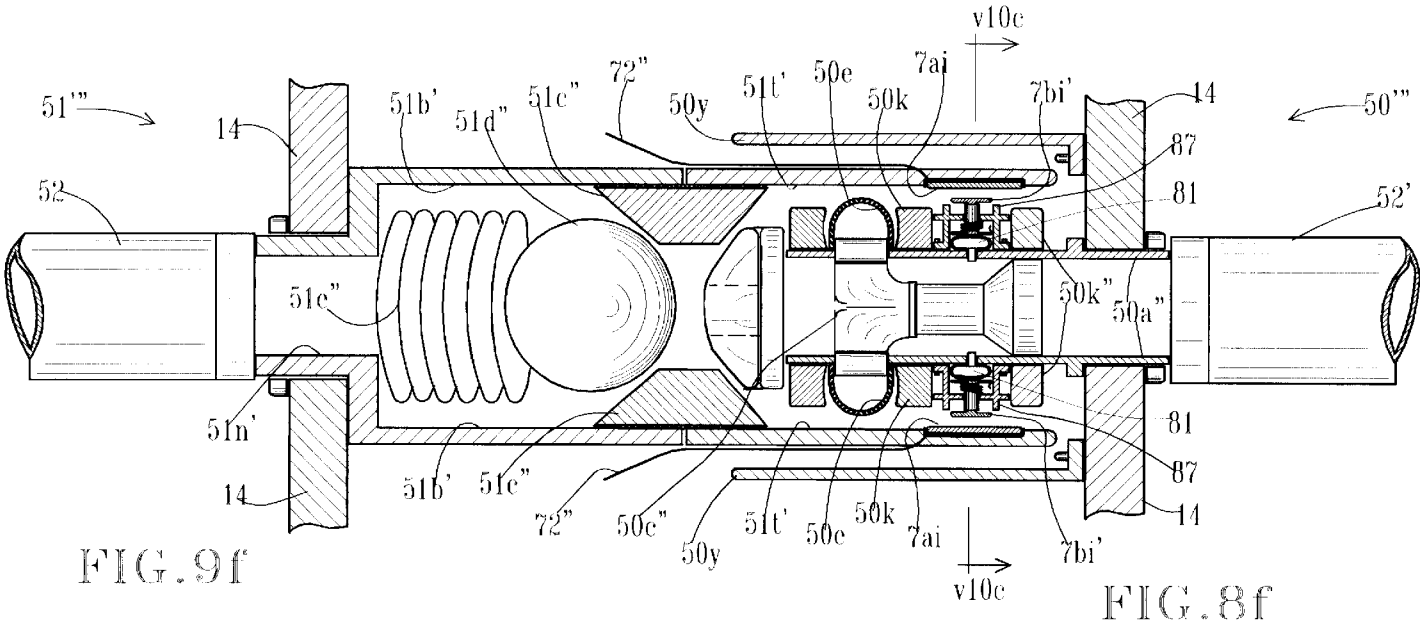
FIG. 8f
FIG. 9f
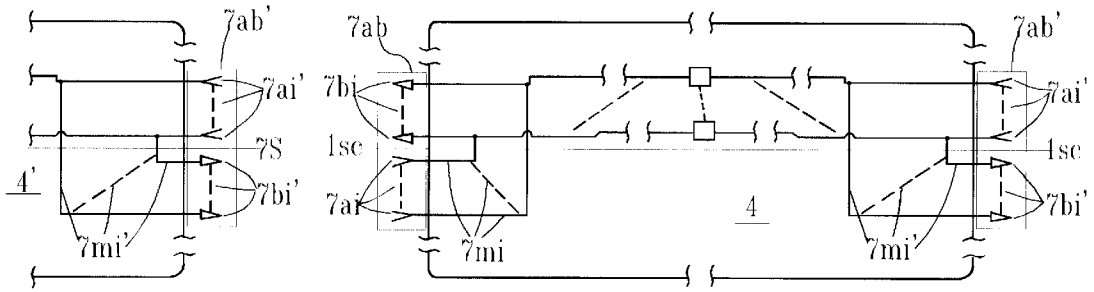
FIG. 12

COUPLING DEVICES FOR RAILWAY CARS

This application claims the benefits of U.S. Provisional patent application Ser. Nos. 60/044,193, filed on Apr. 25, 1997; 60/054,031, filed on Jul. 28, 1997; 60/059,674, filed on Sep. 18, 1997; 60/061,006, filed on Oct. 6, 1997; and 60/076,288, filed on Feb. 27, 1998.

FIELD OF THE INVENTION

The present invention relates in general to the fields of coupling devices and particularly to apparatus and systems for automatically connecting pneumatic and/or electric lines of railroad cars or other articulated vehicles.

As will appear from the ensuing description, the features of the invention may be embodied in coupling systems for railroad freight cars or passenger trains or other articulated vehicles. However, the invention is particularly concerned with and will be described in connection with coupling systems for railroad freight cars.

BACKGROUND OF THE INVENTION

In railroad industry, there have been desires for automatic pneumatic-electric coupling devices for a long time because of the concern for the safety of crewmen when it is necessary to manually couple train hoses. The prior art discloses numerous methods and apparatus for connecting brake lines of a train, such as U.S. Pat. No. 4,015,720 to Peche, U.S. Pat. No. 4,703,862 to Werner, U.S. Pat. No. 4,301,932 to Altherr, U.S. Pat. No. 4,071,148 to Tibbs, U.S. Pat. No. 3,802,578 to Farnworth, U.S. Pat. No. 3,854,597 to McClure et al., and U.S. Pat. No. 3,552,580 to Cope. However, it is not provided in the prior art designs any simple and effective means to automatically seal the juncture area of the coupling. When a rail-car is detached from a train or when train brake-in-two occurs, it is essential that the corresponding juncture areas of the two cars' brake lines common to each other also be disconnected, and in the meantime, air pressure at the compressor source is not lost. However, few of the prior art designs provide appropriate automatic hose-end sealing mechanisms for maintaining air pressure at the compressor source when train brake-in-two occurs. In addition, electric coupling features are not included in the prior art designs because of the difficulties of maintaining perfect electric contact in such an environment.

SUMMARY OF THE INVENTION

Accordingly, an object of the present invention is to provide a rail-car automatic pneumatic coupling system of the type utilizing its own pneumatic-system pressure to automatically seal the coupling juncture.

Another object of the present invention is to provide a rail-car automatic pneumatic coupling system in which additional features, such as hose-end sealing mechanisms for maintaining air pressure at the compressor source when a train brake-in-two occurs, can be included or installed.

A further object of the present invention is to provide a rail-car automatic coupling system in which electric coupling features may also be included.

An even further object of the present invention is to provide a rail-car automatic pneumatic-electric coupling system of the type having novel mechanical means for causing the front portion of the coupling system to maintain close contact with, and to automatically disengage from, that of its substantially identical and oppositely facing coupling counterpart.

To achieve the foregoing and other objects of the present invention and to remedy drawbacks of the prior art described above, there is provided new and improved arrangement of automatic pneumatic-electric coupling systems for railroad cars that shall work in conjunction with the rail-cars' conventional mechanical coupling and draft-gear assembly inserted within the rail-cars' center sill structure. The coupling systems of the present invention are designed in such a standard way of freight-car industry that the coupling structures at the front and rear ends of a freight car are identical, i.e., there is no distinction between the coupling system and its coupling counterpart on the adjacent car. A principle of the present invention is to apply the air system's own pressure for automatically and effectively sealing the coupling juncture.

According to one aspect of the present invention, a pneumatic-electric coupling system includes a pair of male and female front mating heads attached to the front panel of a rectangular front-mating assembly and a male alignment pin and female receptacle device on two sides of said front-mating assembly for guiding said mating heads to their appropriate coupling positions during the coupling. In addition, a hose-end-sealing structure is installed within said rectangular assembly for maintaining air pressure at the compressor source when a train brake-in-two occurs. The aforesaid rectangular front-mating assembly is situated at the front portion of the coupling system of the present invention, and is attached to the undercarriage of a rail-car via a coupler shank with the axis thereof centrally aligned along the longitudinal axis of the car.

The foregoing is intended to be merely a summary and not to limit the scope of the specification. The features of the present invention, which are believed to be novel, are set forth with particularity in the annexed claims. The invention, however, together with further objects and advantages thereof, may best be appreciated by reference to the following detailed description taken in conjunction with the drawings.

BRIEF DESCRIPTION OF THE DRAWINGS

FIGS. 1*a* and 1*b* show, respectively, two oppositely facing pneumatic-electric coupling systems of the present invention, having substantially identical rectangular front-mating assemblies, installed at the undercarriages of two adjacent railroad cars. Similarly, FIGS. 1*c* and 1*d* shows the other two oppositely facing pneumatic-electric coupling systems installed at the undercarriages of two adjacent railroad cars.

FIGS. 8*a*–9*f* are detailed sectional views showing various arrangements of the front male and female mating heads of FIGS. 1–7. The male mating heads of FIGS. 8*c*, 8*d,* and 8*f* are engaged with the female mating heads of FIGS. 9*c,* 9*d,* and 9*f* respectively. The arrows in the figures indicate the paths and directions of the airflow;

FIGS. 8*a*–8*e* are for male mating heads with electric coupling features not included; FIG. 8*f* shows the upgraded male mating head of FIG. 8*b* having electric coupling components mounted at its rear portion and a co-axial cylindrical protection cup mounted on the front-support panel of the rectangular front-mating assembly for protecting said electric components;

FIGS. 9*a*–9*e* are for female mating heads with electric coupling features not included; FIG. 9*f* shows the upgraded female mating head of FIG. 9*b,* having electric coupling components mounted at its front portion.

FIG. 12 is a schematic representation of the connection arrangement of the electric coupler of FIG. 11 installed at the ends of two adjacent freight cars.

FIG. 18*b* is the sectional end views taken substantially along line v18b—v18b of FIG. 1*b*.

DETAILED DESCRIPTION OF THE INVENTION

Figure 1B:
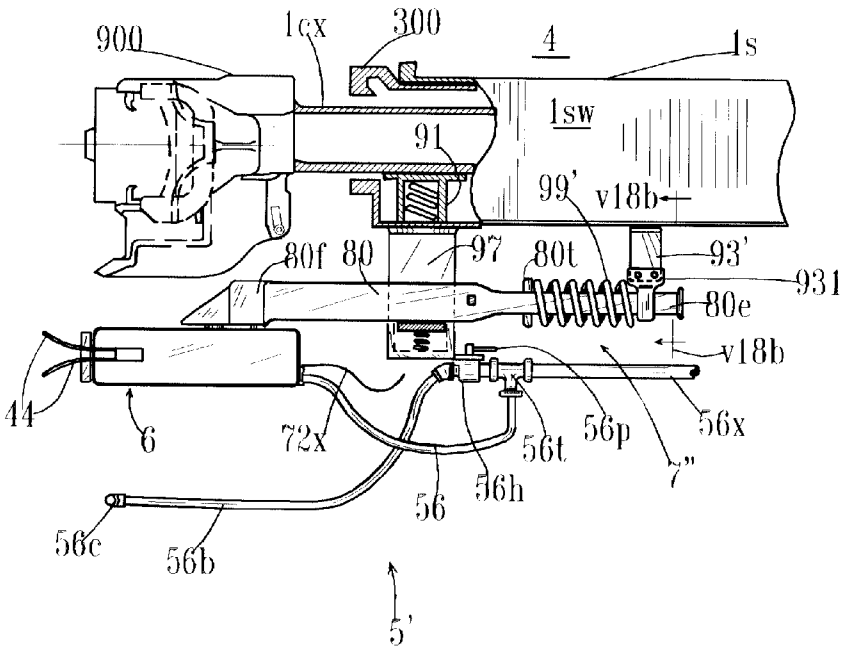
FIGS. 1*a*–1*d* are side elevation views of the coupling systems that embody the concepts of the present invention. The four figures illustrate various installation arrangements for attaching the rectangular front-mating assemblies of said coupling systems to the undercarriages of the respective freight cars.

Referring to FIGS. 1–18, there is shown rail-car pneumatic-electric coupling systems embodying the concepts of the present invention. While the present invention is susceptible to embodiments in various forms, there is in the drawings and will hereinafter be described presently preferred embodiments, with the understanding that the present disclosure is to be considered as exemplification of the invention, and does not limit the invention to the specific embodiments illustrated. In some instances, for purposes of explanation and not for limitation, specific numbers, or dimensions, or materials, etc., may be set forth in order to provide a thorough understanding of the present invention. In other instances, detailed descriptions of well-known mechanical elements or electronic circuitry are omitted so as to not obscure the depiction of the present invention with unnecessary details. In the case when alternate arrangements of a device or a component are described or displayed, like parts or components are assigned with the same reference numbers.

According to the present invention and to freight-car standard, any of the coupling device described herein, which is to be installed at the two ends of a rail-car, and its oppositely facing coupling counterpart on an adjacent rail-car are substantially identical. Therefore, the left-side view of an coupler or coupling system is identical to the right-side view of its coupling counterpart, or vice versa, having a 180-degree rotation symmetry with respect to the vertical axis through the middle point between them. So for the purpose of simplicity, whenever displayed, the components of the coupling system and those of its coupling counterpart are assigned with the same parts numbers; and while the operation of a coupling device or a component is described, the identical operation of its symmetry complement may be omitted.

Figure 1A:
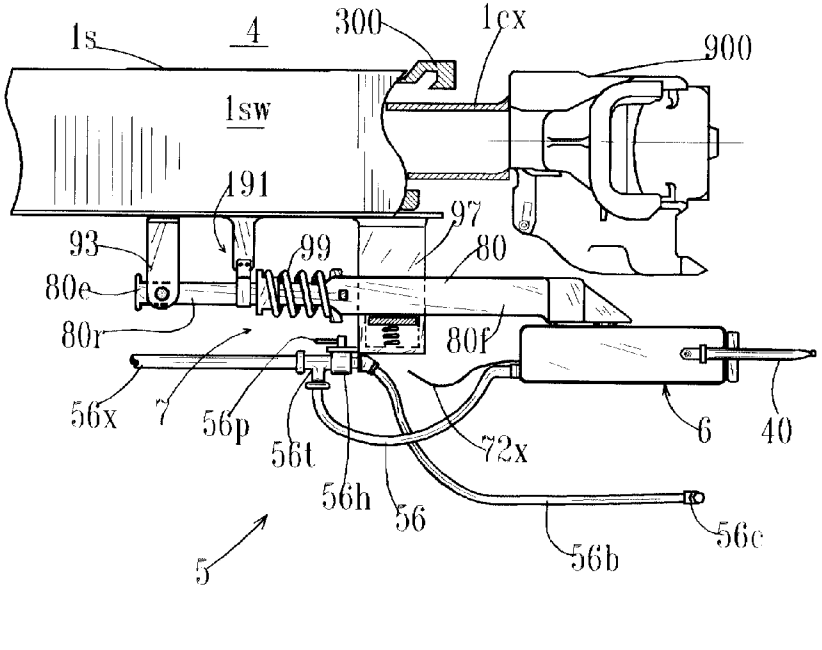

As shown in FIG. 1*a,* a preferred pneumatic-electric coupling system or coupler 5 is installed under the center sill is and the conventional coupler 900 of a railroad car 4. The coupling system 5 includes, according to the present invention, a substantially rectangular front-mating assembly 6, which is attached to a rearwardly extending coupler shank 80, and an installation portion 7 for supporting the coupler shank 80 and hence the front-mating assembly 6 and attaching them to the undercarriage of the car 4. Such a coupling system 5 shall work in conjunction with the conventional mechanical coupler 900 which has a shank 1*cx* received within the center sill is of the car 4. The installation portion 7 of the coupling system 5 of the present invention includes a front shank-support assembly 97 for supporting the front-middle section of the coupler shank 80, a rear shank-support assembly 93 for supporting the rear portion 50*r* of the coupler shank 80, and a coupling-position-control assembly 191 for urging the front-mating assembly 6 of the coupling system 5 to its front-most position for maintaining close contact with its coupling counterpart. An air hose 56 is provided for connecting the rail-car 4's brake line 56*x* to the rectangular front-mating assembly 6.

Figure 2:
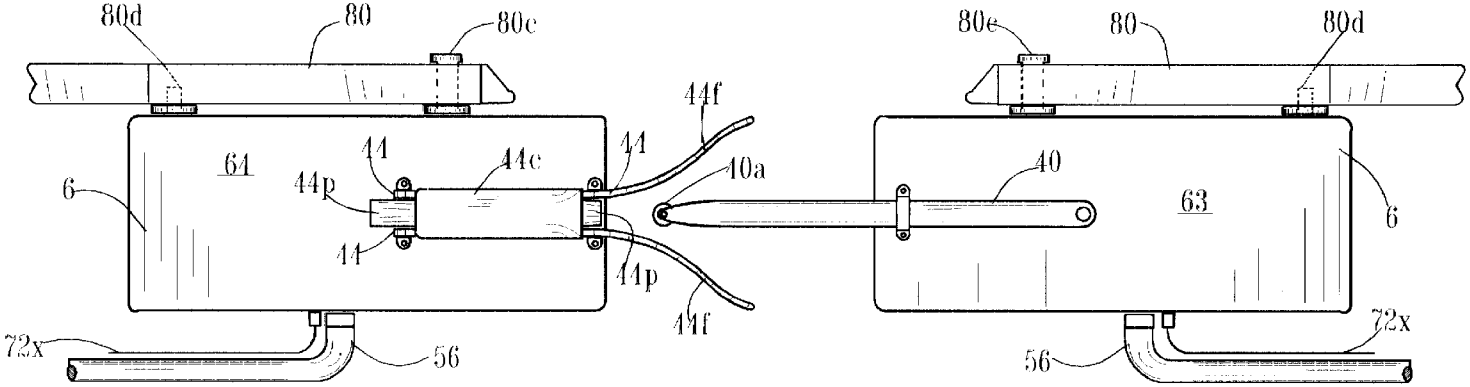
FIG. 2 is a side elevation view, to an enlarged scale, showing two oppositely facing and substantially identical rectangular front-mating assemblies of the pneumatic-electric coupling systems of FIG. I c.

Referring now to FIGS. 2–3, there is shown that the rectangular front-mating assembly 6 of the coupling system 5, taking form of a rectangular box, comprises a top plate 60, a bottom plates 62, two side walls 63 and 64, and a rear plate 61. The members 60, 61, 62, 63, and 64 of the rectangular assembly 6 can be affixed to each other by bolting, or screwing, or welding or any other conventional fastening means, or any two of them can be an integrated casting structure.

A male alignment or guiding pin 40 is secured to the external of the side-wall 63 of the box 6. Concurrently, a Y-shaped female alignment receptacle is affixed to the external of the side wall 64 of the box 6. As shown in the figures, said female receptacle comprises a pair of oppositely facing guiding plates 44 affixed perpendicularly to the external of the side wall 64. Each of the members 44 has an arc-shaped front guiding portion 44*f* and a rear straight portion parallel to the longitudinal line of the train. A cover 44*c* is affixed to the external edges of the rear straight portions of the two guiding plates 44. In this way, the external of the side wall 64, the rear straight portions of the two guiding plates 44, and the cover 44*c* form a horizontal rectangular tunnel for guiding and receiving the male alignment pin 40 of the coupling counterpart of the coupler 5 during the coupling and aligning process. The arc-shaped front portions 44*f* of the guiding plates 44 provides vertical alignment mechanism for guiding the male alignment pin 40. It is preferred that the minimum vertical distance between the two guiding plates 44 at their rear portion is equal to or slightly larger than the vertical thickness of the front portion of the male guiding pin 40.

Figure 3A:
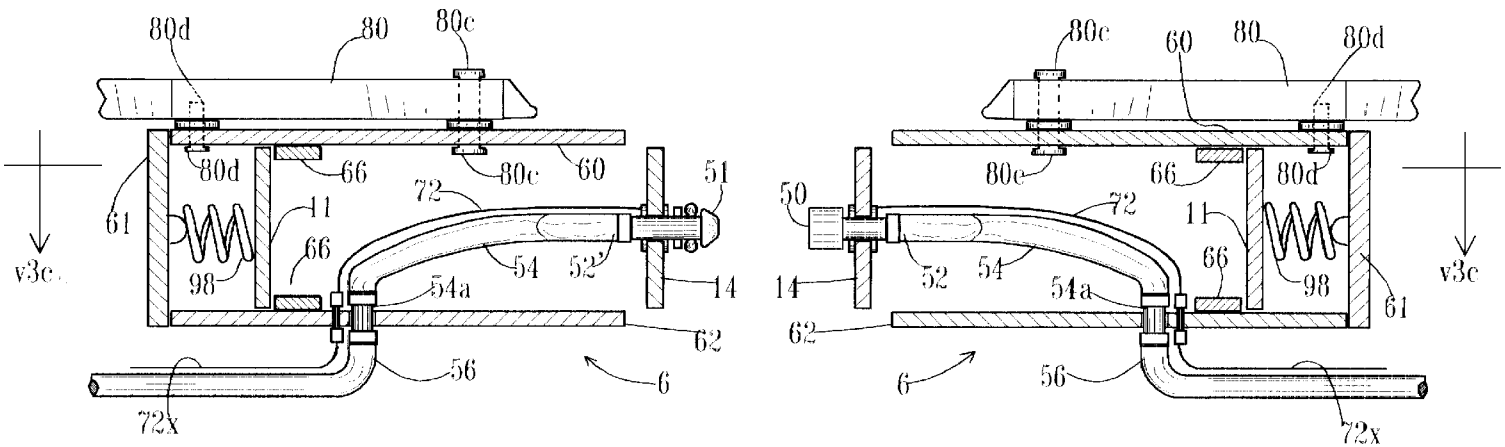
FIG. 3*a* is a lateral sectional view showing the first preferred embodiment of the rectangular front-mating assembly of the pneumatic-electric coupling systems of FIGS. 1. In this figure, two substantially identical and oppositely facing rectangular front-mating assemblies in uncoupled condition are depicted.
Figure 3B:
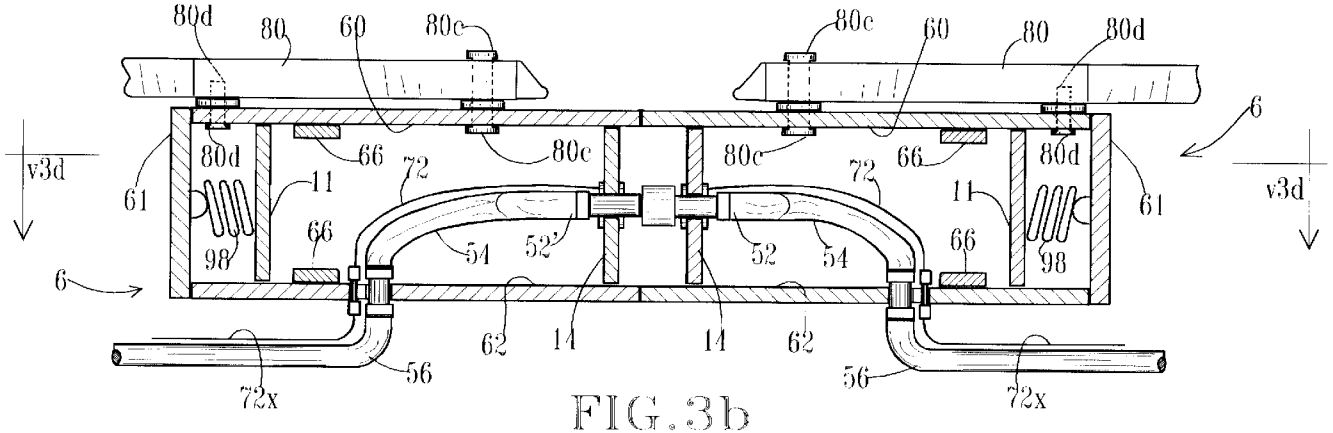
FIG. 3*b* shows the two couplers of FIG. 3*a* in coupled mode.
Figure 3C:
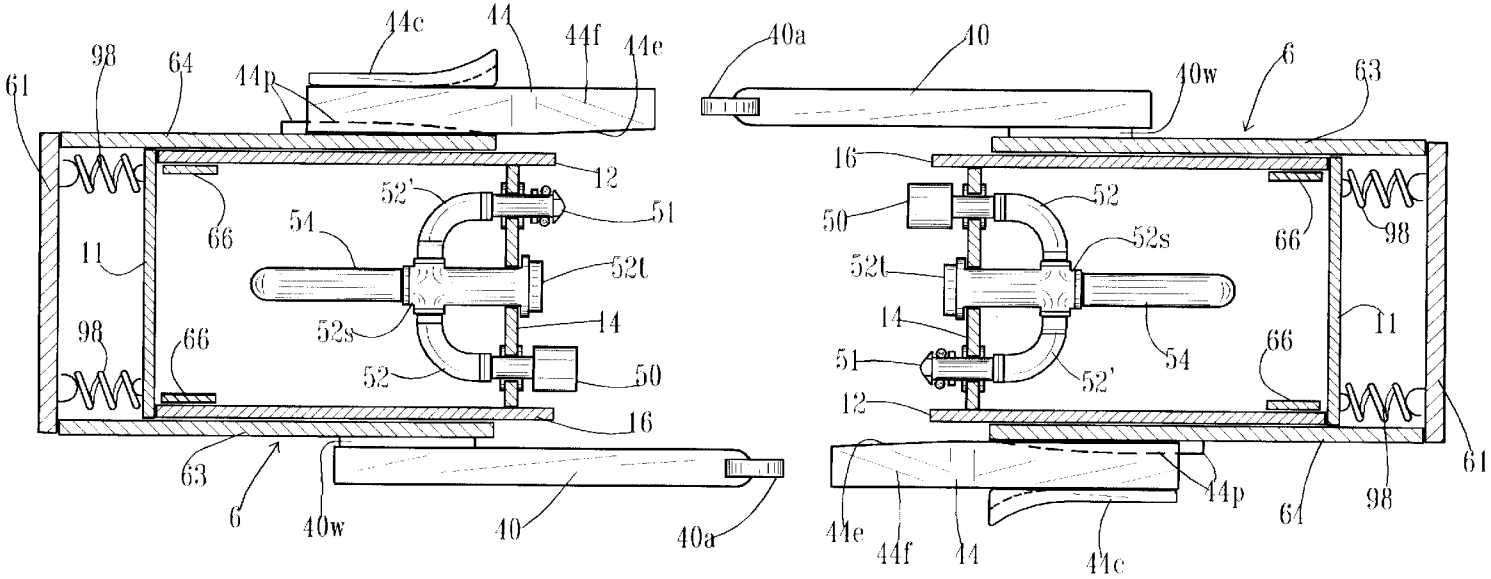
FIGS. 3*c* and 3*d* are horizontal sectional plane views taken along lines v3c—v3c and v3d—v3d of FIGS. 3*a* and 3*b* respectively.
Figure 3D:
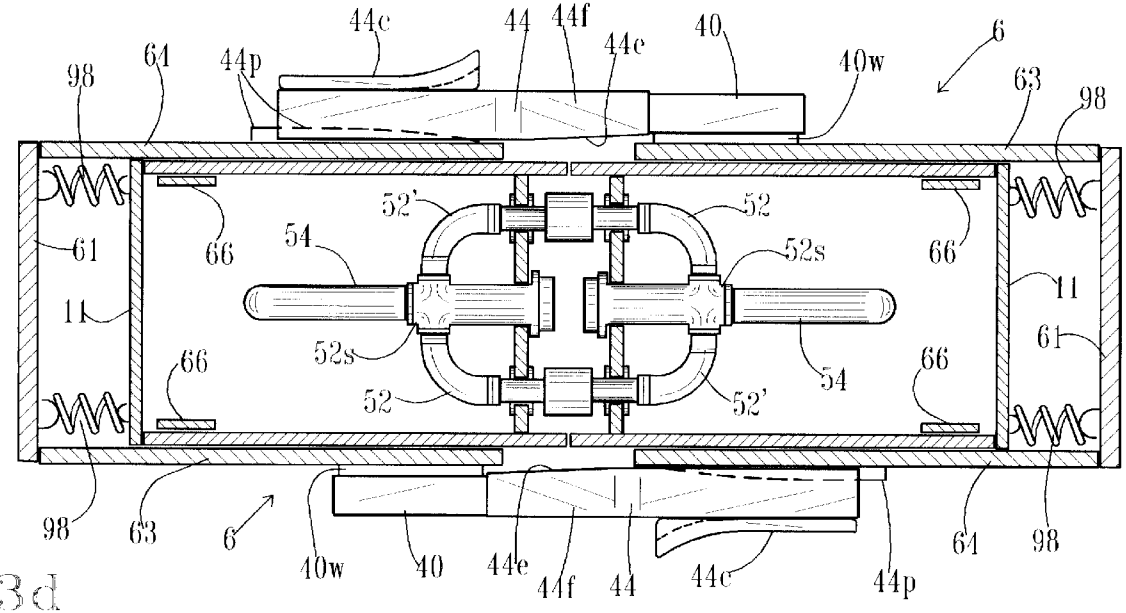

In order to improve or optimize horizontal alignment, a guiding spacer 44*p* is affixed to the external of the wall 64 between the two female guiding plates 44, as shown in the figures. The thickness of the guiding spacer 44*p* increases gradually from zero at its front end to an appropriate thickness at its rear end. It is also preferred, as shown in FIGS. 3*c*–3*d,* that the front portion of the cover 44*c* is bending toward the external of the box 6, and that the minimum distance between the spacer 44*p* and the cover 44*c* at their rear end is equal to or slightly larger than the lateral thickness of the front portion of the male guiding pin 40. In this way, the spacer 44*p* and the cover 44*c* provide a horizontal alignment mechanism for guiding the male alignment pin 40. The alignment members 40, 44*p,* and 44 can be affixed to the respective side walls 63 and 64 of box 6 by welding or bolting or screwing or any other conventional fastening means, or they can be integrated with the respective side walls 63 and 64 as consolidated casting structures.

Figure 5A:
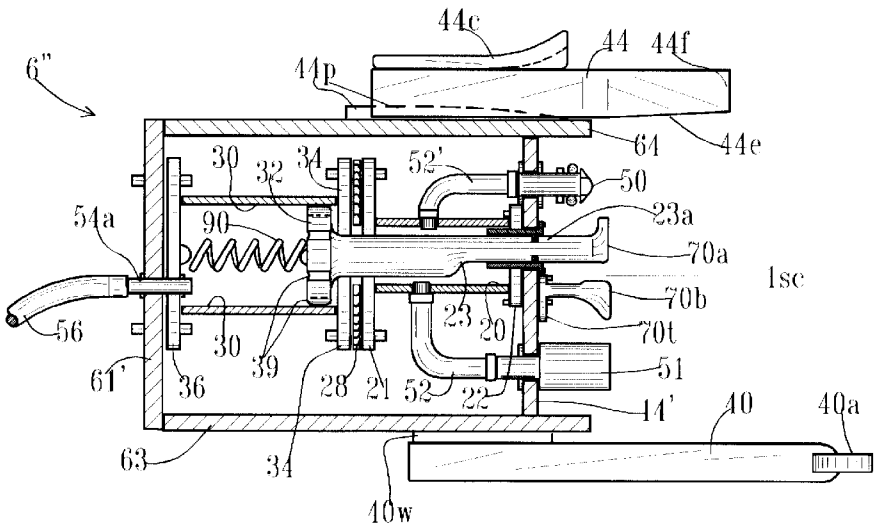
FIG. 5*a* is a horizontal sectional plane view showing the third preferred embodiment of the rectangular front-mating assembly of the pneumatic-electric coupling systems of FIGS. 1.
Figure 5B:
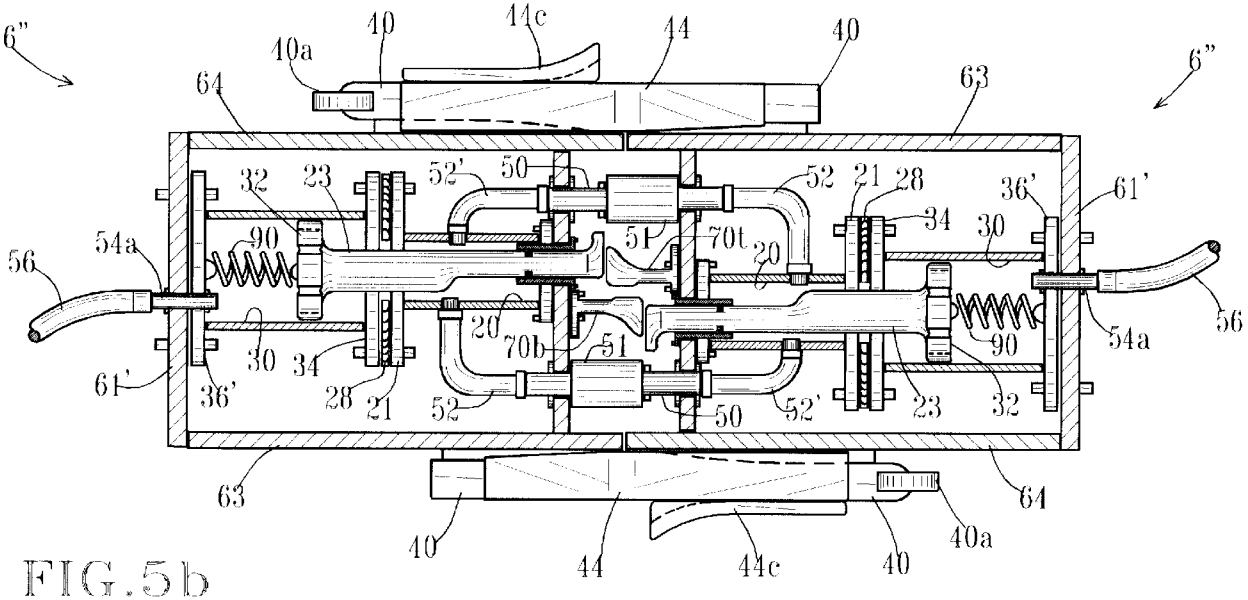
FIG. 5*b* shows two substantially identical and oppositely facing rectangular front-mating assemblies of FIG. 5*a* engaged with each other.

It is understood that the male and female guiding elements 40 and 44 are for guiding the front-mating assembly 6 of the coupling system 5 to its appropriate coupling position with respect to its substantially identical and oppositely facing coupling counterpart on the adjacent car during the coupling process (FIGS. 3*d* & 5*b*). In order to avoid direct head-on collision between the guiding pin 40 and the side wall 64, a spacer 40*w,* which may be a thin plate, can be inserted between the guiding pin 40 and the side wall 63 of the box 6; Alternatively, the width of the front end of the pin 40 can be made smaller for the same purpose. Similarly, the width of the front portion 44*f* of the female guiding plate 44 can be made smaller to avoid head-on collision between its inner edge 44*e* and the side wall 63. In order to reduce friction between the front portion of the male guiding pin 40 and the female guiding plates 44, the guiding pin 40 can be provided with a rotatable friction-reduction wheel 40*a* with the horizontal axis thereof affixed to the front end of the pin 40.

It is appreciated that the vertical gathering forces for aligning the front-mating assemblies 6 of two coupling systems 5 on two encountering rail-cars come from the interaction between the male guiding pin 40 and the front portion 44*f* of one of the female guiding plates 44, and the friction thereof are reduced by the wheel 40*a* of the pin 40. Similarly, the horizontal gathering forces for aligning the two encountering front-mating assemblies 6 come from the interaction between the male guiding pin 40 and the elements 44*p* and 44*c* of the female receptacle. In order to facilitate appropriate coupling operations of the front pneumatic-electric mating components of the coupling system 5, the length of the male alignment pin 40 and the geometry of the female receptacle members 44, 44*p,* and 44*c* shall be arranged properly to accommodate possible height differences between two railroad cars' chassis and the position differences of the front-mating assemblies 6 on two encountering rail-cars in both horizontal and vertical directions.

Figure 7:
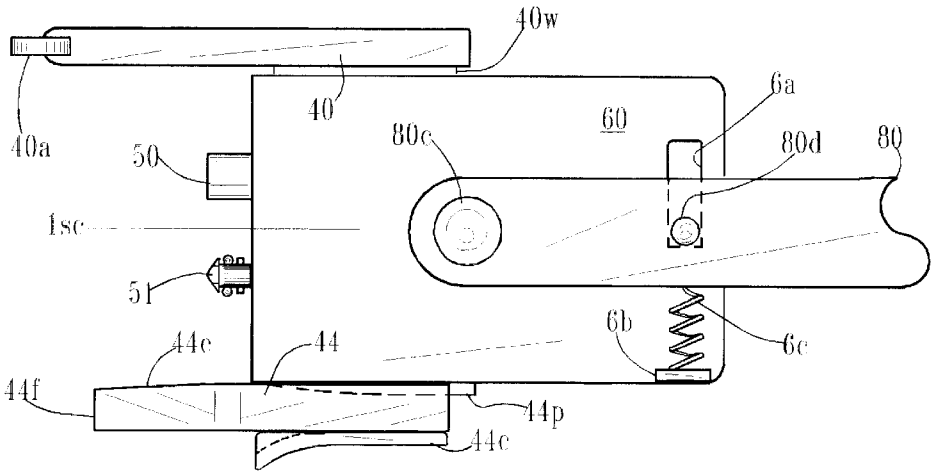
FIG. 7 is a top plane view of the rectangular front-mating assembly of the coupling systems of FIGS. 1.

It is understood that the front-mating assembly 6 of the coupling system 5 may be attached to the coupler shank 80 by welding or bolting or any other conventional attaching means known to those in the art. However, in order to accommodate the situation when two adjacent rail-cars are on a curved track, it is preferred that there is a certain degree of horizontal rotation freedom between the box 6 and the coupler shank 80. Referring now to FIG. 7 in conjunction with FIGS. 2–3, there is shown the preferred arrangement of attaching the front-mating assembly 6 to the coupler shank 80. As shown in the figure, the front-center portion of the top plate 60 of the box 6 is pivotally attached to the front end of the coupler shank 80 by a vertical pivot 80*c*. The vertical rotation freedom of the shank 80 with respect to the box 6 is restricted by a bolt 80*d,* which is threadly engaged with the shank 80 from underneath the plate 60 of the box 6, passing across an elongated slot 6*a* at the rear portion of the plate 60. Certainly, the diameter of the head of the bolt 80*d* under the plate 60 shall be substantially larger than the width of the elongated slot 6*a* of the plate 60 otherwise, a washer shall be provided therein. A bias spring 6*c* is connected between the coupler shank 80 and a fixed element 6*b* at the left edge of the top plate 60 for controlling the default position of the shank 80 with respect to the box 6. It is appreciated that the bolt 80*d* and the pivot 80*c* affix the box 6 to the coupler shank 80 vertically, while the aforesaid slot aperture 6*a* on plate 60 and the bolt 80*d* provide the box 6 with limited rotation freedom about the vertical pivot 80*c*. At default condition when there is no external force on the box 6, the bolt 80*d* threaded onto the coupler shank 80 is biased by the spring 6*c* against the inner side of the slot 6*a*. The position of the elongated slot 6*a* on the plate 60 shall be arranged in such a way that at the aforesaid default condition, the longitudinal symmetry line of the plate 60 is aligned along the coupler shank 80 and hence along the vertical central plane 1*sc* of the rail-car 4.

Figure 1D:
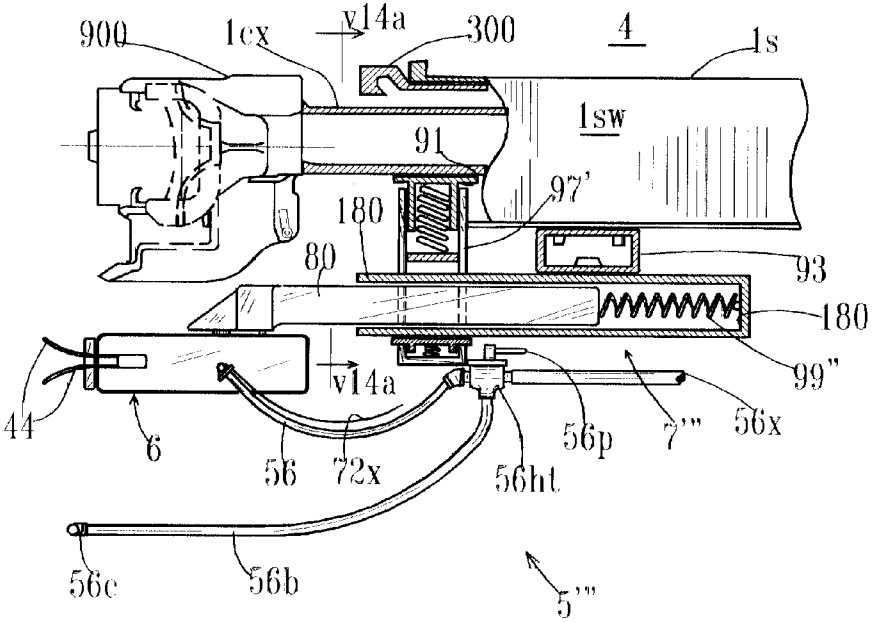
Figure 1E:
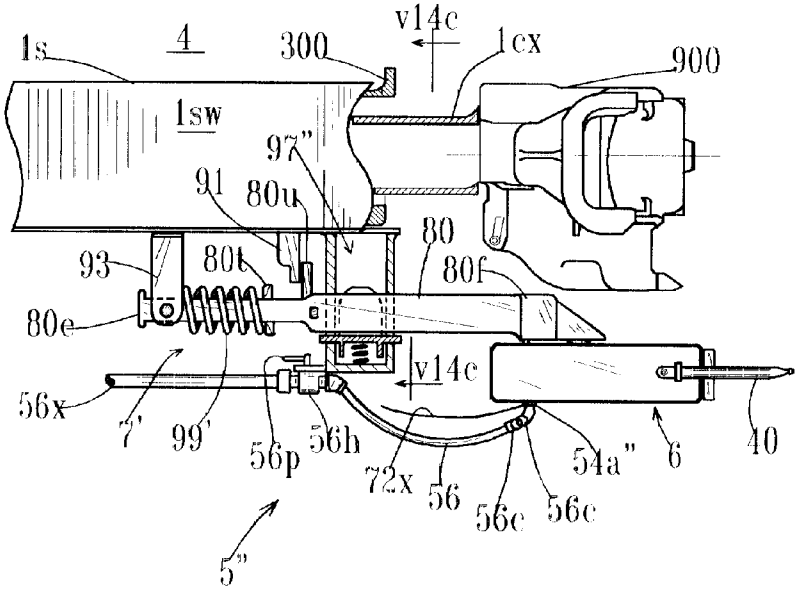

The coupler shank 80 is directly supported, at its middle and rear portions, respectively, by the front and rear shank-support assemblies 97 and 93 of the installation portion 7 of the coupling system 5, as shown in FIGS. 1*a*–1*c,* which will be described in details later in the specification. Alternatively, the rear portion of the coupler shank 80 can be received within a rearwardly extending rectangular channel 180 with the front and rear portion of the rectangular channel 180 supported by the front and rear shank-support assemblies 97 and 93 respectively, as shown in FIG. 1*d.* In this figure, a compressing spring 99" is attached to the rear closed end of the channel 180 with the other end of the spring 99" affixed to the rear end of the shank 80 so that there is a cushion mechanism between the channel 180 and the shank 80 received therein. The purpose of introducing such a cushion mechanism for the coupling system 5'" is to accommodate the relative movement between two adjacent rail cars 4 caused by draft or buff load on the mechanical coupler 900. Alternative, such a cushion mechanism can be provided by a spring 99 mounted on the coupler shank 80, as shown in FIGS. 1*a*–1*c,* with detailed description thereof provided later in the specification.

In order for the coupling system 5 of the present invention to provide appropriate pneumatic and/or electric coupling, it is essential that the rectangular front-mating assembly 6 and its coupling counterpart on the adjacent car maintain close contact with each other while in coupled mode, and such contact should be independent of the draft or buff load on the mechanical couplers 900 of the two cars. So it is preferred that a coupling-position-control assembly 191 (FIGS. 1) is provided at the installation portion 7 of the coupling system 5, with details thereof described later in the specification. Alternatively, an independent mechanical coupling system can be attached to the top of the box 6 if said coupling-position-control assembly 191 is not provided.

Referring now again to FIGS. 3*a*–3*d,* there is shown the first preferred inside arrangement 6 of the rectangular front-mating assembly of the coupling system 5 of the present invention. As shown in these figures, an external pneumatic connection port 54*a* is mounted onto the bottom plate 62 of the box 6 via a through hole provided thereon for pneumatically connecting the hose 56 of the rail-car 4 to an interior connection hose or conduit 54 inside the box 6. The electric cable 72*x* of the rail-car 4 is connected to an electric cable 72 inside the box 6 via a electric connector mounted on the bottom plate 62. The front end of the hose 54 in the box 6 is pneumatically connected to a pair of male and female mating heads 50 and 51 at the front via a hose-split device 52*s* and via two respective hoses or conduits 52' and 52. The electric cable 72 is connected to the front electric-coupling elements of the coupling system 5, as will be described later. The hose-split device 52*s* comprises a front support 52*t,* an inlet at its rear side to which the front end of the hose or conduit 54 is pneumatically connected, and two outlets on its two sides that are pneumatically connected to two air hoses or conduits 52' and 52 respectively. The front ends of the two hoses or conduits 52' and 52 are connected pneumatically to the aforesaid male and female mating heads 50 and 51 respectively. The two mating heads 51 and 50 and the front support 52*t* of the hose-split device 52*s* are mounted across a rectangular front support panel 14, via respective passage-through-holes provided thereon at appropriate positions, by any conventional attachment means known to those in the art. Alternatively, the male and female mating heads 50 and 51 can be replaced by a single conduit installed at the center of the plate 14 and connected directly to the air hose 54.

The front support panel 14 is secured at its two sides to two movable or sliding side plates 12 and 16 within the box 6 by means of welding or bolting or other feasible fastening means. It is preferred that the sliding plates 12 and 16 are situated next to the inner sides of the external side plates 64 and 63 of the box 6 respectively. The rear ends of the two side supports 12 and 16 are attached to a back plate 11 so that the four plates 11, 12, 14, and 16 form an interior rectangular sliding box which may slide back and forth within the box 6. The top and bottom of said sliding box are left open to facilitate the connection of the air hose 54 with the connection port 54*a*. A plurality of compression springs 98 are disposed between the plate 11 and the rear plate 61 of the external box 6. The limitation to the movement range of the sliding elements 11, 12, 14, and 16 is provided by a plurality of limit blocks 66 against the plate 11. The limit blocks 66 are affixed to the interior of the box 6's top and bottom plates 60 and 62 with appropriate lateral distances provided between them and the respective side plates 63 and 64 of box 6 in order for the two sliding plates 16 and 12 being disposed next to the respective side plates 63 and 64 of the external box 6. At uncoupled mode when there is no external force, said back plate 11, along with the interior sliding elements 12, 16, and 14 and with the elements 50, 51, and 52*s* attached thereto, is biased forwardly by the springs 98 against the limit blocks 66.

It is understood that in order for protecting the male/female mating heads 50/51, the front edges of the sliding side plates 12 and 16 shall extend forwardly to an appropriate distance beyond the front surface of the front support panel 14. During the coupling, the front edges of the plates 12 and 16 will encounter their counterparts when the male and female mating heads 50 and 51 of the coupler 5 are engaged with their respective female and male mating heads of the counterpart coupler on the adjacent car at desired relative engagement positions. It is appreciated that the introduction of the aforesaid interior sliding box can prevent the relative movement between the front mating heads 50/51 of the coupler 5 and those of its coupling counterpart while in coupled mode, since the springs 98 always compress the two mating heads 50 and 51 forwardly against their counterpart coupling mates regardless of the movement of the box 6. Such close contact between the front coupling components of the coupler 5 and those of its coupling counterpart is especially important if electric coupling is required, as will be described later.

Since the aforesaid interior sliding box and those elements attached thereto have limited travel, it is preferred that construction of the hose 54 inside the box 6 is of conventional soft materials for air hoses such as rubber or the like or other feasible materials to facilitate such travel. The construction of other components of the front-mating assembly 6 may be of standard rigid materials such as steel or other feasible materials. Alternatively, the hoses 52 and 52' may also be made of the aforesaid soft materials.

Figure 4A:
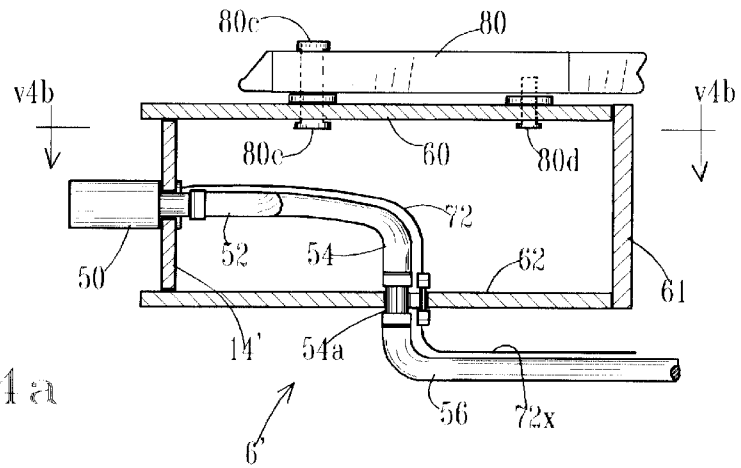
FIG. 4*a* is a lateral sectional view showing the second preferred embodiment of the rectangular front-mating assembly of the pneumatic-electric coupling systems of FIGS. 1.
Figure 4B:
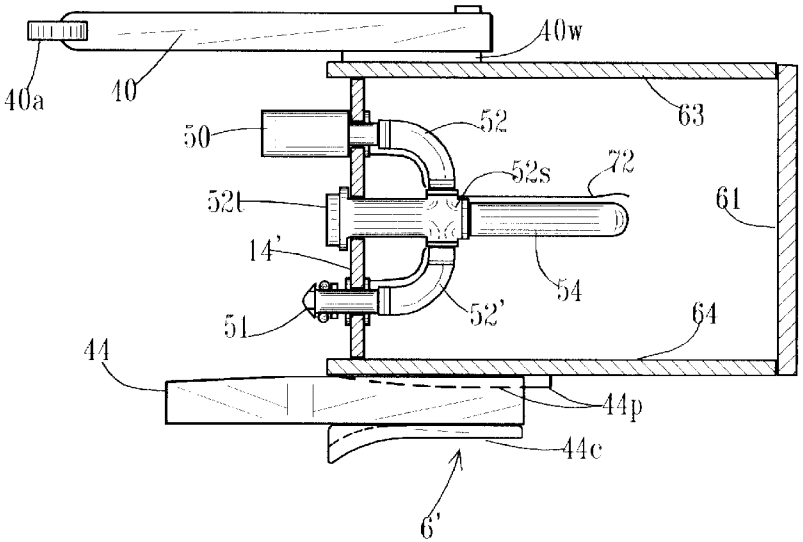
FIG. 4*b* is a horizontal sectional plane view taken along line v4b—v4b of FIG. 4*a*.

Referring now to FIGS. 4*a*–4*b*, there is shown the second preferred embodiment 6' of the interior arrangement of the rectangular front-mating assembly of the coupling system 5 of FIGS. 1, in which the interior sliding elements 11, 12, and 16 and the springs 98 of FIGS. 3 are not included. As shown, the front support panel 14', along with the male and female mating head 50 and 51 mounted thereon, is secured directly, at its four sides, to the front portions of the top, bottom, and side plates 60, 62, 63, and 64, respectively, of box 6' by means of welding or bolting or screwing or other conventional fastening means. Other arrangement within the box 6', including the arrangement for the conduits 54, 52, 52', the cable 72, the mating heads 50 and 51, and for the conduit-split device 52*s*, as well as all the components and arrangement thereof on top and at two sides of the box 6', are the same as those described above for the first preferred embodiment 6 of the front-mating assembly of FIGS. 3. It is understood that the front edges of the plates 60, 62, 63, and 64 shall extend forwardly to appropriate distances beyond the front surface of the front support panel 14' so that the encountering of the plates 60, 62, 63, and 64 with their counterparts during the coupling process will stop the relatively movement of the male/female mating heads 50/51 at appropriate coupling positions with respect to their coupling counterparts on the adjacent car.

Figure 5C:
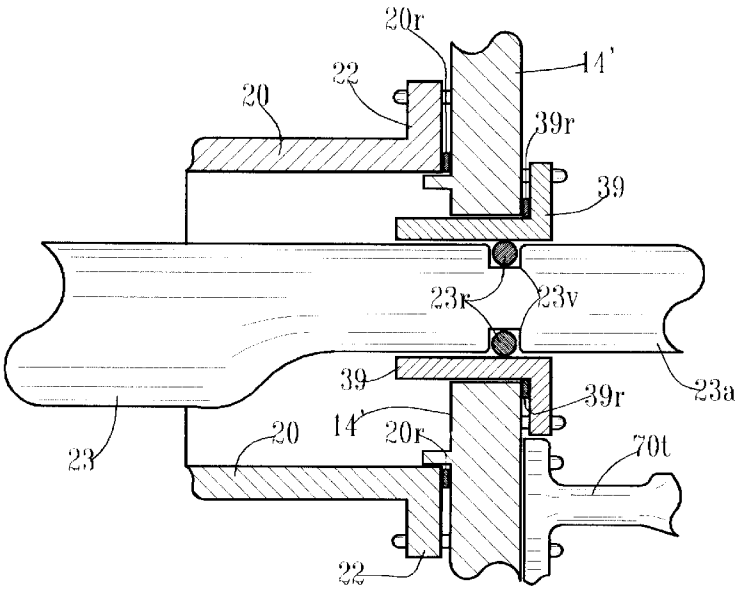
FIG. 5*c* is a fragmentary sectional view, to an enlarged scale, of the front central portion of the rectangular front-mating assembly of FIG. 5*a,* showing detailed arrangement for sealing the juncture between the front portion of the piston rod and the front support panel of the rectangular front-mating assembly of FIG. 5*a*.
Figure 6:
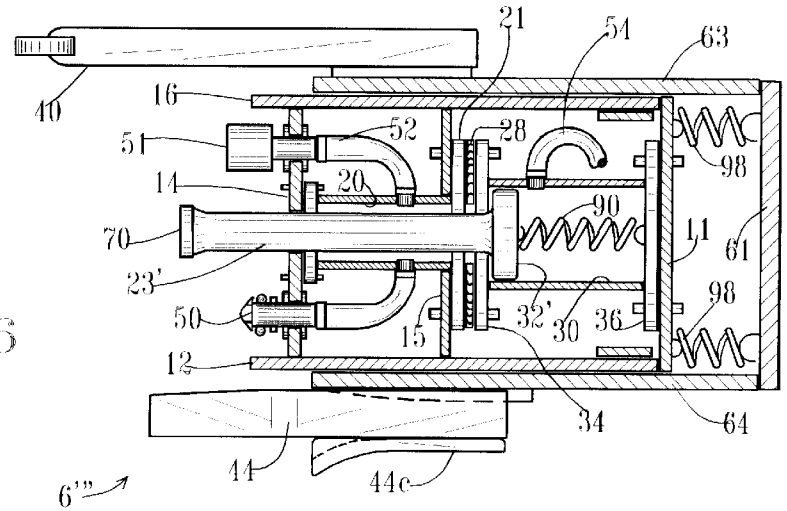
FIG. 6 is a horizontal sectional view showing the fourth preferred embodiment of the rectangular front-mating assembly of the coupling systems of FIGS. 1.

In many cases, it is necessary for an automatic pneumatic coupling system to seal the ends of the brake lines for maintaining air pressure at the compressor source when train-brake-in-two occurs. Accordingly, a hose-end sealing structure can be included in the above-described front-mating assembly 6 or 6'of FIGS. 3–4. Referring now to FIGS. 5*a*–5*b* and FIG. 6 there is shown, respectively, the third and forth preferred embodiments 6" and 6'" of the interior arrangements of the front-mating assembly of the coupling systems of the present invention. Similar to the above-described front-mating assembly, the boxes 6"/6'" of FIGS. 5/FIG. 6 include external support plates 63, 64, 61', 62, 60, and front-support panel 14'/14. The structures and components at the externals of the box 6"/6'"and the arrangements thereto, including the mechanical arrangement at the top of the box 6'/6'", the method of attaching the box 6'/6'" or its top plate 60 to the coupler-shaft 80, and the arrangements for the alignment elements such as elements 40 and 44 and the methods of attaching them to the two sides of the box 6", are the same as described above in conjunction with FIGS. 1—4 and 7. In FIG. 5, the front support panel 14', alone with the male an female mating heads 50 and 51 mounted thereon, is secured to the external support plates 63, 64, 62, 60 of box 6", which is similar to the arrangement of FIG. 4; while in FIG. 6, the front support panel 14, alone with the male an female mating heads 50 and 51 mounted thereon, is secured to the interior sliding plates 12 and 16 within the box 6'", which is similar to the arrangement of FIG. 4.

Compared with the interior arrangement of FIGS. 3–4, the air-split device 52*s* therein is replaced by two flanged air chambers or cylinders 20 and 30 connected to each other in FIGS. 5–6. As shown in the figures, the air cylinder 20 has a rear flange 21 at its rear end and, at its front end, a front flange 22 mounted onto the front support panel 14'/14 with appropriate seal therefore provided. The cylinder 30 also has a front flange 34 and a rear flange 36 at its front and rear ends respectively. In FIGS. 5, the rear flange 36 of cylinder 30 is mounted onto the inner side of the rear plate 61' of box 6" with appropriate seal therefore provided; while in FIG. 6, the rear flange 36 of cylinder 30 is mounted onto the back plate 11 of the interior sliding structure. In both FIGS. 5 and FIG. 6, the front flange 34 of the cylinder 30 is mounted onto the rear flange 21 of the cylinder 20 with an annular rubber seal 28 sandwiched between them (the word "rubber" here stands for any type of feasible soft sealing materials, and is not limited to any particular type of rubber). Alternatively, the two cylinders 20 and 30 can be an integrated structure. Also alternatively, an interior middle-support plate 15 can be provided within the box 6"/6'" for supporting the two flanges 21 and 34 of the respective cylinders 20 and 30 (FIG. 6).

Also similar to the arrangements of FIGS. 3–4, a pair of male and female mating heads 51 and 50 are mounted across the front support panel 14'/14 via the respective passage-through-holes provided thereon at appropriate positions. The air chamber of cylinder 20 is pneumatically connected to the two mating heads 50/51 via two air hoses 52' and 52 respectively. In FIGS. 5, the brake line 56 of the car 4 is pneumatically connected to the air cylinder 30 at its rear end via an external connection port 54*a* mounted onto the rear plate 61' of box 6". Alternatively, said external connection port 54*a* can be mounted onto the bottom plate 62 of box 6'" and connected to the cylinder side wall of the air chamber 30 via an interior connection hose 54, as shown in FIG. 6.

In both FIGS. 5 and FIG. 6, a piston 32 is disposed within the air cylinder 30. The diameter of the piston 32 is equal to or slightly smaller than the interior diameter of the cylinder 30. The piston 32 may have a plurality of air-passing grooves 39 at its circumference edge for allowing airflow to pass between the air chamber 20 and the external connection port 54*a* at the rear end of the chamber 30, as shown in FIGS. 5. Alternatively, the air-passing grooves 39 may not be necessary if the diameter of the piston 32 is substantially smaller than that of the interior of the cylinder 30, or if the connection port 54*a* is mounted onto the bottom plate 62 and pneumatically connected to the air chamber 30 at its cylindrical side wall instead of at its rear end, as shown in FIG. 6. In both FIGS. 5 and FIG. 6, a cylindrical shaft or piston rod 23 of appropriate length is attached at its rear end to the center of the piston 32. The front portion of the piston shaft 23 extends forwardly to the external side of the front-support panel 14'/14 of box 6'/6'", passing through the chamber 20 and a through-hole provided on the front-support panel 14'/14. A compression spring 90 is received within the rear portion of the air chamber 30 for urging the piston 32 forwardly against the annular seal 28. It is now appreciated that in uncoupled condition or after a train-brake-in-two occurs when there is no external force at the front end of the piston shaft 23, the spring 90 and the air pressure from the brake line 56 will push the piston 32 against the rubber seal 28, stopping the airflow from passing between the chambers 20 and 30. This is the desired automatic hose-end sealing mechanisms for the brake line 56.

It is preferred and as shown in FIGS. 5 that the air cylinders 20 and 30 within the box 6" and the through holes on the front support plate 14' that receives the rod 23*a* are positioned in such a way that the front cylindrical portion 23*a* of the piston rod 23 are completely at one side of a vertical symmetry plane 1*sc* of the box 6" which is also the vertical symmetry plane of the car 4. The purpose of such an arrangement is to facilitate the installation of a piston-thrust casting 70*t* onto the front support plate 14' by appropriate fastening means. Such a piston-thrust casting 70*t* is to compress the piston rod 23 of the counterpart coupling system during the coupling. It is preferred that the position of the piston-thrust 70*t* and the front portion 23*a* of the piston rod, and the geometric forms of their respective front surfaces 70*a* and 70*b,* are symmetric with respective to the symmetry plane 1*sc*. It is understood that the front portion 23*a* of the piston rod 23 and the piston-thrust 70*t* shall extend forwardly from the front panel 14' of the box 6" to an appropriate distance. It should also be understood that the front edges of the side-support plates 63/64 and the top/bottom plates 60/62 of box 6" shall extend forwardly from the front plate 14' to an appropriate distance in order to protect the mating heads 51 and 50 and to facilitate appropriate engagement of these mating heads with their respective coupling counterparts during the coupling.

Reference is now made to FIG. 5*b.* During the coupling when two oppositely facing coupling systems or couplers 5 on two adjacent cars encounter one another, their male and female alignment members 40 and 44 will properly align the two encountering front-mating assemblies 6". Then before the encountering of the front edges of the plates 63, 64, 60, and 62 of box 6'" with their counterparts on the other side, the thrust 70*t* will encounter the front portion 23*a* of the piston rod 23 on the other side, pushing the piston 32 toward the rear end 36' of the chamber 30 against the spring 90; In the meantime, the male/female mating heads 50/51 will engage with their counterpart female/male coupling mates on the other side respectively. So, after the two front-mating assemblies 6" of the two cars are engaged with one another, the piston 32 will be unseated from the annular seal 28, allowing airflow to pass between the external connection port 54*a* and the mating heads 50/51. It is now appreciated that, after the coupling, the two air hoses 56 at the rear ends of the two oppositely facing boxes 6" in FIG. 5*b* are pneumatically connected via the cylinders 20 and 30 and via the mating heads 51 and 50.

Alternatively, the positions of the air chambers 20 and 30 and hence position of the piston shaft 23' within the box 6'" may be arranged in such a way that their central axes are along the central symmetry plane 1*sc* of the box 6'", as shown in FIG. 6. In this case, the piston-thrust casting 70*t* of FIGS. 5 should not be included. During the coupling, the front portion 70 of the piston shaft 23' will encounter the piston shaft of the counterpart coupler of an adjacent car, pushing the piston rearwardly against the spring 90. So after the front-mating assemblies 6'" of the two cars are engaged with one another, the piston 32 will be unseated from the annular seal 28, allowing airflow to pass between the external connection port 54*a* and the mating heads 50/51.

It is understood that appropriate pneumatic sealing mechanism should be provided at all junctures of the pneumatic coupling systems described herein when necessary. For examples, as shown in FIG. 5*c,* in order to prevent any air leak between the piston rod 23*a* and the front panel 14', a flanged cylinder 39 is mounted across the plates 14' at an appropriate position with an annular rubber seal 39*r* situated between the front flange of the cylinder 39 and the plate 14'. The front piston rod 23*a* is received within and passing across the through-bore of the cylinder 39. The diameter of the inner bore of the cylinder 39 is equal to or slightly larger than that of the front portion 23*a* of the piston rod 23. The pneumatic seal between the cylinder 39 and the piston rod 23*a* is provided by at least one annular rubber seal 23*r* received within the respective annular groove 23*v* provided on the piston rod 23*a,* as shown in the figure. The cylinder 39 should be long enough so that the rubber seal 23*r* shall always be within the cylinder 39 during the travel of the piston rod 23. The pneumatic seal between the cylinder 20 and the front plate 14' is provided by an annular rubber seal 20*r* disposed between the front flange 22 of the cylinder 20 and the plate 14'.

As described above, the two elements 50 and 51 mounted onto the front-support panel of the front-mating assembly 6 are a pair of male and female mating heads, which are engagable with and disengagable from the female and male mating heads, respectively, of the substantially identical and oppositely facing automatic air-hose coupling apparatus 5 of the adjacent car. Referring now to FIGS. 8–10, there is shown the preferred and alternate arrangements of the female and male mating heads of the coupling system 5 of the present invention. Again, the principle for designing these mating heads is to use the pneumatic system's own air pressure to seal the coupling junctures.

As shown in FIG. 8*a,* the male mating head 50 includes a conduit 50*a,* which is pneumatically connected to the air hose 52' (FIGS. 3–6) at its rear end, and is plugged into the bore of a conical protection head 50*f* at its front end. The conduit 50*a* may be mounted across the front support panel 14 of box 6 by any conventional fastening means known to those in the art. Surrounding the front portion of the conduit 50*a* right behind the protection head 50*f* is a tubular juncture-sealing rubber air ring 50*e* (rubber here represents, in general, any conventional inflatable or other type of feasible materials known to those in the field of pneumatic seal). The air ring 50*e* may or may not be inflatable, and it should have a large enough inner diameter to transmit air pressure. The air ring 50*e* is pneumatically connected to the air conduit 50*a* via an air-receiving orifice boss 50*t* and an air-return orifice boss 50*p* on the conduit 50*a,* as shown in the figure. Within the conduit 50*a,* a cylindrical conical cup 50*b* is received within, affixed to, and engaged with the bore of the conduit 50*a* at an appropriate position for guiding the airflow into the air ring 50*e* before reaching the front end of the conduit. The exterior diameter of the rear portion of the conical cup 50*b,* which is larger than that of its front portion 50*s,* is equal to the inner diameter of the bore of the conduit 50. The front portion 50*s* of the cup 50*b* is pneumatically connected to the orifice boss 50*t* and to the air ring 50*e* via an elbow or "L-shaped" air-connection pipe 50*c*. The L-shaped pipe 50*c* has an inlet engaged with the front portion 50*s* of the cup 50*b* and an outlet engaged with the orifice boss 50*t*.

It is understood that, appropriate seal shall be provided wherever it is necessary; and that the connections of the air-guiding elements 50*b* and 50*c* within the conduit 50*a* shall be arranged in such a way that if there is any air pressure from the hose 52', the airflow will be guided by these elements to pass through and inflate the air ring 50*e* before it reaches the front open end of the conduit 50*a,* as indicated by the arrows 5*i* in the figure. The airflow will, following the direction of the arrows 5*i,* flows into the air ring 50*e* via the conical cup 50*b*, the elbow 50*c*, and the orifice boss 50*t* of the conduit 50*a;* then the airflow will come out of the air ring 50*e* from the orifice boss 50*p* of the conduit 50*a* and return to the front open end of the conduit 50*a*. For the purpose of protecting the air ring 50*e* and preventing it from being removed from its position, as will be described later, an annular protection element 50*k,* such as a annular collar or a nut or the like, can be provided and affixed at the external of the conduit 50*a* right behind the rubber air ring 50*e,* as shown in the figure.

Figure 10A:
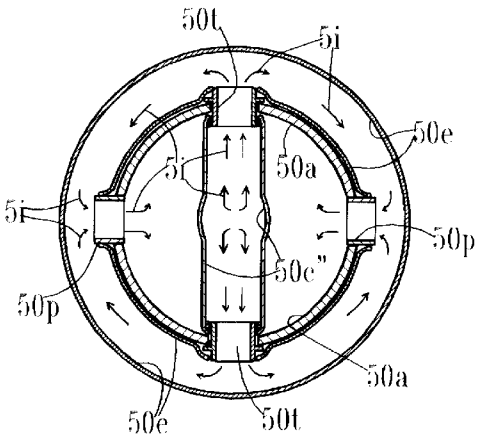
FIG. 10*a* is a cross-sectional view taken along line v10a—v10a of FIG. 8*b*.
Figure 8B:
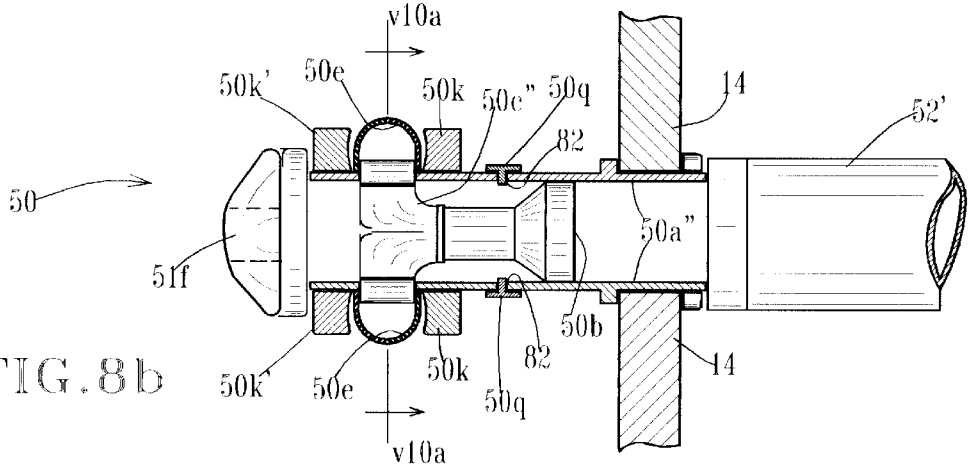

Alternatively, there can be more than one air-return orifice bosses 50*p* and air-receiving orifice bosses 50*t* at the front portion of the conduit 50*a* for connecting to the air ring 50*e;* or other methods and apparatus for guiding the airflow through the rubber rings 50*e* may also be employed. For example, as shown in FIG. 8*b,* the elbow or the so-called L-shaped element 50*c* of FIG. 8*a* is replaced by a "Tee" or a T-shaped hose-split device 50*c*" within the conduit 50*a;* For the purpose of protecting the air ring 50*e,* a second protection collar 50*k*' is provided and affixed at the external of the conduit 50*a* right at the front side of the rubber air ring 50*e,* as shown in the figure; In addition, in order to install electric-coupling components onto the male mating head 50, as will be described later in conjunction with FIG. 8*f,* a plurality of additional orifices are provided on the conduit 50*a,* and an annular seal 50*q* is provided for blocking air leak at these orifices when said electric-coupling components are not installed. Other elements of the male mating head of FIG. 8*b* and the arrangements thereto are similar to or the same as those of FIG. 8*a.* FIG. 10*a* displays the cross-sectional view taken substantially along the line v10a—v10a of FIG. 8*b.* As shown in FIG. 8*b* and FIG. 10*a,* there are two air-receiving orifice bosses 50*t* and two air-return orifice bosses 50*p* on the conduit 50*a* for connecting to the air ring 50*e.* The Tee 50*c*" has a rear inlet pneumatically connected to the front portion 50*s* of the cup 50*b* and two side outlets pneumatically connected to two orifice bosses 50*t* of the conduit 50*a.* When there is an air pressure in the hose 52', the air will flow into the air ring 50*e* via the two orifice bosses 50*t* on the conduit 50*a,* guided by the cylindrical elements 50*b* and the Tee 50*c*". Then the airflow will come back from the air ring 50*e* and return to the front open end of the conduit 50*a* via the two air-return orifice bosses 50*p* on the conduit 50*a.*

Reference is now made to FIG. 9*a.* The female mating head 51 comprises a cylindrical cup which includes a rear neck portion 51*n* with smaller diameter for pneumatically connecting to the air hose 52 (FIGS. 3–6), and a front portion 51*b* with larger diameter for receiving the above-described male mating head 50 during the coupling. It is obvious that the inner diameter of the front portion 51*b* of the female head 51 should be larger than the exterior diameter of the protection members 50*f* or 50*k* of the male mating head 50. The female member 51 may be mounted across the front support panel 14 of box 6 at its front or rear neck portion by any conventional feasible fastening means known to those in the art. It is appreciated that when the male mating head 50 of FIG. 8*a* is engaged with the female mating head 51 of FIG. 9*a,* the sealing mechanism for preventing air leak at the juncture between them is provided by the high-pressured rubber air ring 50*e* of the male head 50 against the inner surface 51*m* of the female cup 51*b* (FIGS. 8*c*/9*c* and FIGS. 8*f*/9*f*).

In order to provide perfect seals, it is preferred that the male-female coupling structures described herein shall only allow one-way airflow, i.e., from the male head 50 to the female head 51, blocking the airflow in the opposite direction. This is realized by a conical rubber valve head 51*d* and an annular valve seat 51*c* provided within the female cylindrical cup 51*b.* As shown in FIG. 9*a*, the valve seat 51*c* is affixed to the front interior surface 51*m* of the cup 51*b.* The valve head 51*d* and the valve seat 51*c* form an one-way check-valve structure inside the female mating head 51, although any other types of one way check-valve structures known to those in the art may also be employed. The conical rubber valve head 51*d* has a shaft 51*f* inserted in and supported by a support cylinder 51*o* at the center of a cross 51*g* provided. A light compressing spring 51*e* is mounted on the front portion of the shaft 51*f* between the cylinder 51*o* and the valve head 51*d* for urging the valve head 51*d* forwardly against the valve seat 51*c.* The cross-sectional view of FIG. 9*a,* taken substantially along line v10f—v10f, is illustrated in FIG. 10*f.* As shown in FIG. 9*a* and FIG. 10*f*, the cross 51*g* and its central cylinder 51*o* are situated inside the rear neck portion 51*n* of the female head 51. The cross 51*g* includes a plurality of radial support bars 51*h* for supporting the cylinder 51*o*. The radial bars 51*h* are attached to a surrounding ring 51*i* which is affixed to the bore of the rear neck portion 51*n* of the female head 51. Alternatively, the surrounding ring 51*i* can be made with larger diameters so that the entire check-valve structure, including the valve head 51*d,* the shaft 51*f,* the cross 51*g,* and the spring 51*e* mounted on the shaft 51*f* can be installed within the front portion 51*b* of the female head 51.

It should be understood that a conduit 51*a* can be provided to connect between the hose 52 and the rear portion 51*n* of the female head 51 of FIG. 9*a,* and the entire check valve structure described above, including the conical valve head 51*d* and the valve seat 51*c,* can be made with smaller diameters and installed within the conduit 51*a,* as shown in FIG. 9*d.* It should also be understood that the shaft 51*f* of the valve head 51*d* of FIG. 9*a* may not be necessary, and the spring 51*e* therein can be disposed directly between the valve head 51*d* and the cross 51*g*". In FIG. 9*d,* the conical valve head 51*d* of FIG. 9*a* is replaced by an elastomeric ball valve 51*d*"; a conical valve seat 51*c*' is received within the bore of the conduit 51*a* at an appropriate position; and a compressing spring 51*e* is connected between the elastomeric ball valve 51*d*" and a support cylinder 51*o* provided within the conduit 51*a* for urging the ball valve 51*d*" against the valve seat 51*c*". The structure of the support cross 51*g*" and the cylinder 51 0 at its center in FIG. 9*d* is similar to the one shown in FIG. 10*f,* and the structure and arrangements of the front cylindrical cup 51*b* of the female head 51 is similar to that of FIG. 9*a.*

Figure 9B:
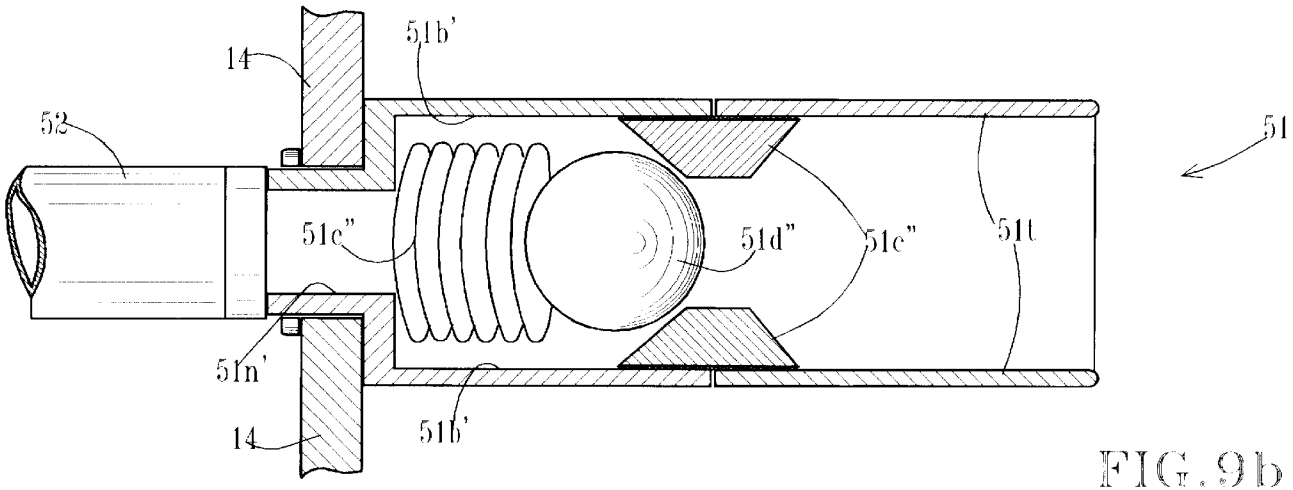

It is understood and as shown in FIG. 9*b* that the elastomeric ball valve 51*d*", the spring 51*e,* and the conical valve seat 51*c*" of FIG. 9*d* may also be made with larger diameter and installed at the front portion of the female cup 51*b.* In FIG. 9*b,* the spring 51*e*" has larger diameter than the rear neck portion 51*n*'0 of female head 51, and is situated at the rear end of the cup 51*b*' against its rear bottom or the front edge of its rear neck 51*n*'; Therefore, the conduit 51*a* and the cross 51*g* of FIG. 9*d* is not included in FIG. 9*b*. As shown in FIG. 9*b,* an annular valve seat 51*c*" is provided in front of the ball valve 51*d*". The rear half of the annular valve seat 51*c*" is threaded into the bore of the front end of the cup 51*b*'. It is understood that the valve seat 51*c*" also serves as an engaging element herein for connecting another cylinder 51*t*, which has same inner diameter as the cup 51*b*', to the front end of the cup 51*b*' by means of threading between the front half of the member 51*c*" and the cylinder 51*t*. The purpose of introducing the cylinder 51*t* is for receiving the male mating head 50 during the coupling, which is similar to the arrangement of FIG. 9*a* and FIG. 9*d,* except that the cylinder 51*t* can be disconnected from the cup 51*b*' and replaced by another cylinder that has electrical coupling components installed at its front portion, as will be described later in the specification in conjunction with FIG. 9*f.*

It is appreciated that when the front mating assembly 6 of the coupling system 5 of FIGS. 1 is coupled with the substantially identical and oppositely facing front mating assembly of the counterpart coupling system on the adjacent car, its front male and female mating heads 50 and 51 will be engaged with the oppositely facing female and male mating head 51 and 50 respectively. When there is no pressure on it, the valve head 51*d* within the female head 51 will be biased by the spring 51*e* against the valve seat 51*c;* When air pressure from the female side is larger than that of the male side, such air pressure will compress the valve head 51*d* against the valve seat 51*c,* blocking the airflow from coming out of the female head 51. It is preferred that the weight of the valve head 51*d* and the strength of the spring 51*e* should be as light as possible so that a slight air pressure from male mating head 50 would be able to compress the valve head 51*d* rearwardly against the spring 51*e* for allowing airflow passing through from the male head 50 to the female head 51, as indicated by the arrows 5*i* in the figures. It is also preferred that the front support panel 14 should be mounted the onto external support plates 60, 62, 63, and 64 of box 6 (FIGS. 5) at appropriate positions so that the when the front edges of these external support plates of box 6 encounter their respective counterparts, the female head 51 is coupled with the male head 50, and the protection head 50*f* of the male conduit 50*a* is situated very close to the annular valve seat 51*c* within the female 51 without any contact thereto.

It is also appreciated that the check-valve or the one-way airflow arrangement within the female mating head 51 described above will not affect the two-way performance of the entire pneumatic coupling system 5 of the present invention; As shown in FIGS. 3–6, each coupling box 6 has a male and a female mating head 51 and 50; in coupled condition, there are two pairs of male and female mating heads coupled together between the two coupling systems 5 on two adjacent cars, which provide two opposite one-way air passes. So the entire coupling system can allow airflow in either direction.

It should be understood that when the male mating head 50 of FIGS. 8 is coupled with the female head 51 of FIGS. 9, the air pressure at the interior 5*x* of the female cylindrical cup 51*b* can be much larger than the external pressure. Such pressure differences will tend to push the air ring 50*e* out of the female cup 51*b* and disengage it from the bosses 50*t* and 50*p* of the male conduit 50*a* if the protection member 50*k* is not provided. Another potential problem is during the uncoupling process, in which, because of the high pressure in the air ring 50*e,* the large friction forces between the air ring 50*e* and the inner surface 51*m* of the female cup 51*b* may also disengaging the air ring 50*e* from the bosses 50*t* and 50*p* of the male conduit 50*a* if the protection member 50*k*' (FIG. 8*b*) is not provided. So it is appreciated that the purpose of providing the air-ring protecting members 50*k* and/or 50*k*' for the male mating head 50 is for keeping the position of the air-ring 50*e* during the coupling-uncoupling processes; The position of the air ring 50*e* on the male head 50 is affixed to the conduit 50*a* of the male 50 by the bosses 50*p* and 50*t* of the conduit 50*a*.

It is understood that there can be various ways of modifying the above-described male and female mating heads of the present invention. For examples, FIG. 8*c* shows one of the alternative arrangements of the male mating head 50, in which the air-guiding elements within the conduit 50*a* of FIG. 8*a*, including the elements 50*b* and 50*c* therein, are not included; the airflow from the hose 52' can flow directly to the front open end of the conduit 50*a* without passing through the air ring 50*e* first. The arrangement for the air ring 50*e* and the conduit 50*a* in FIG. 8*c* is similar to those of FIG. 8*a*. The disadvantage of such an arrangement is that there could be some air leak before air pressure is completely built up within the entire pneumatic system. Again, there can be a plurality of orifices on the conduit 50*a* that connect to the air ring 50*e*. An alternative arrangement for the female mating head 51 is shown in FIG. 9*c,* in which the female mating head 51 shown is engaged with the male mating head of FIG. 8*c*. As shown in the figure, the one-way check-valve structure of FIG. 9*a*, including the valve head 51*d,* the valve seat 51*c,* the spring 51*e,* and the valve-head-supporting elements 51*g,* 51*i,* and 51*f* therein, are not included in the female cup 51*b* of FIG. 9*c;* i.e., the female mating head 51 of FIG. 9*c* only comprises a cylindrical cup 51*b* for receiving the counterpart male mating head 50 during the coupling. Such an alternative arrangement of FIG. 9*c* of the female mating head 51 has similar disadvantage, i.e., there could be some air leak before air pressure is completely built up within the entire pneumatic system.

Figure 10B:
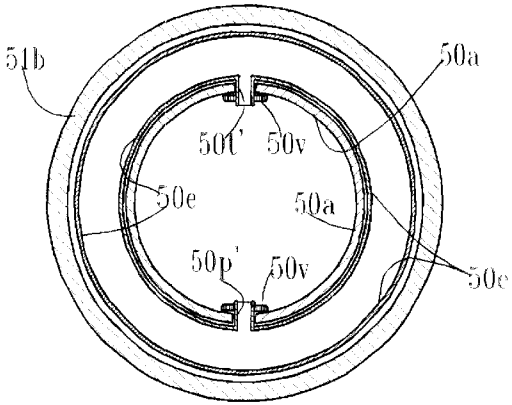
FIG. 10*b* is a cross-sectional view taken along line v10b—v10b of FIG. 8*c* and FIG. 9*c*.
Figure 10F:
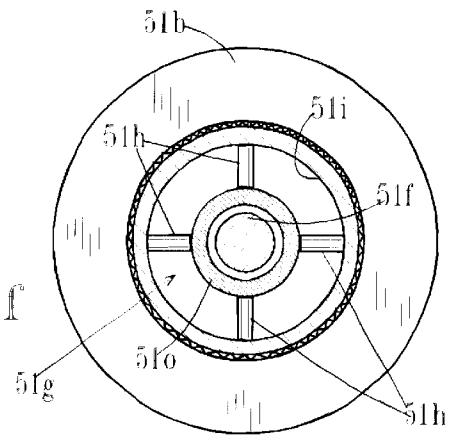
FIG. 10*f* is a cross-sectional view taken along line v10f—v10f of FIG. 9*a*.

The cross-sectional view of FIGS. 8*c* and 9*c* taken along line v10b—v10b is shown in FIG. 10*b*. As shown in FIGS. 10*a,* the orifice bosses 50*t* and/or 50*p* can be integrated parts of the conduit 50*a*. They can be affixed to the conduit 50*a* by means of welding or nut-threading or other conventional fasten means known to those in the art. In such a case, the bosses 50*t* and/or 50*p* shall be plugged into the respective apertures provided on the inner side of the air ring 50*e,* as shown in the figure. Alternatively, the bosses 50*t* and/or 50*p* may be integrated with the air rings 50*e*. In this case, as shown in FIG. 10*b,* these bosses 50*t*'/50*p*'0 of the air ring 50*e* can be plugged in to the respective apertures provided on the conduit 50*a,* and be affixed to the conduit 50*a* by nuts 50*v* threadly engaged with the bosses 50*t*'/50*p*' from the interior of the conduit 50*a*. Certainly, any other feasible means for pneumatically connecting the air ring 50*e* to the conduit 50*a* can also be employed.

It should be understood, in regarding the structure of the male mating head 50, that the position of the rubber air ring 50*e*" surrounding the conduit 50*a* may not coincide with the positions of the orifice bosses 50*t* and 50*p* of the conduit 50*a*, as shown in FIG. 8*d* for another alternative arrangement of the male mating head 50". In FIG. 8*d*, a plurality of tubular air-guiding members 50*u* and 50*v* are provided for pneumatically connecting the respective air-receiving orifice boss 50*t*" and air-return orifice boss 50*p*" of the conduit 50*a* to the air ring 50*e*"; The arrangements for the air-guiding elements 50*b,* 50*s,* and 50*c* within the conduit 50*a* and their connection with the respective orifice bosses 50*t*" and 50*p*" of the conduit 50*a* are the same as or similar to those of FIG. 8*a*. As shown in FIG. 8*d,* the airflow from the hose 52'is guided into the air ring 50*e*", from its rear side instead of from underneath or inner surface as shown in FIG. 8*a*, by the airflow-guiding members 50*b* and 50*c* within the conduit 50*a* and via the orifice boss 50*t*" which is pneumatically connected to the ring 50*e*" by the tubular member 50*u*. The airflow will pass through the air ring 50*e*" and then reaches the front open end of the conduit 50*a* via the tube 50*v* which is connected between the air ring 50*e*"0 and the orifice boss 50*p*" of the conduit 50*a,* as indicated by the arrows 5*i* in the figure. As shown, the male mating head 50" of FIG. 8*d* is engaged or coupled with the female mating head 51" of FIG. 9*d,* with the coupling juncture thereof sealed by the high-pressured air ring 50*e*" of the male head 50" against the inner surface of the female cup 51*b*.

Alternatively, the juncture-sealing air ring 50*e,* together with the associated airflow-guiding members 50*b* and 50*c* of the male mating head 50 described above, can be installed within the female head 51'; Concurrently, the check valve structure of the female mating head described above can be installed within the male head 50', as shown in FIGS. 8*e* and 9*e* respectively. In FIG. 9*e,* which shown the alternative arrangement of the female mating head 51', a rubber air ring 50*e* is situated at the front interior of the cylindrical female cup 51*b'* behind an annular conical protection member 51*w* received within the cup 51*b'* at its open end; A conduit 51*a'* is provided to connect between the hose 52 and the rear neck portion 51*n'* of the female cup 51*b'*. As shown in FIG. 9*e,* similar to the arrangement for the corresponding elements of FIG. 8*d,* a plurality of air-receiving and air-return orifice boss 50*t'* and 50*p'* are provided on the conduit 51*a'*; airflow-guiding elements 50*b'* and 50*c'* of similar arrangement are provided within the female conduit 51*a'*; and a plurality of tubular member 50*u'* and 50*v'* are provided for pneumatic connection between the air ring 50*e'* and the respective air-receiving and air-return orifice boss 50*t'* and 50*p'* on the conduit 51*a'* of the female head 51'. As shown, said tubular members 50*u'* and 50*v'* pass across from within the front interior of the female cup 51*b'* to the external of the conduit 51*a*. Alternatively, the connection tube 50*v'* and the orifice boss 50*p'* may not be necessary, since the airflow can come back to the front of the cup 51*b'* from the air ring via any aperture provided on the air ring. The corresponding male mating head 50' of the female head 51' of FIG. 9*e* is shown in FIG. 8*e*. As shown, the check-valve structure within the female cup 51*b* of FIG. 9*a*, including the valve head 51*d'*, the return spring 5 i*e'*, the valve-shaft support member 51*g'*, and the valve seat 51*c'*, are installed within the conduit 50*a'* of the male mating head 50' in the same manner as those of FIGS. 9*a*or 9*b* or 9*d*. As shown, the male mating head 50' of FIG. 8*e* has a protection head 50*f'*.

It is understood that when the male and female mating heads 50' and 51' of FIGS. 8*e* and 9*e* are coupled together, the airflow can only pass from the female 51' to the male 50'; The airflow in the opposite direction is blocked by the check-valve head 51*d'* against the conical valve seat 5 ic' within the conduit 50*a'* of the male head 50'. If the air pressure from the hose 52 is larger than that of the hose 52' at the male side, the airflow will be guided by the air-flow-guiding members 50*b'* and 50*c'* within the conduit 51*a'* of the female head 51' and by the tube 50*u'* outside the conduit 51*a'* into the air-ring 50*e'* within the female cup 51*b'*. After the airflow passes through the air ring 50*e'*, it will return to the front portion of the female cup 51*b'* and into the male mating head 50', guided by the tube 50*v'*. It is appreciated that pneumatic seal for the coupling juncture is provided by the inflated and high-pressured air-ring 50*e'* within the female cup 51*b'* against the external surface of conduit 50*a'* of the male head 50'. Alternatively, the airflow-guiding members 50*b'* and 50*c'* within the conduit 51*a'* of the female mating head 51' may not be included; and/or the check valve structure within the conduit 50*a'* of the male head 50', including the vat head 51*d'*, the valve seat 51*c'*, and the supporting elements 51*g'* and 51*e'*, may also be unnecessary.

Figure 11:
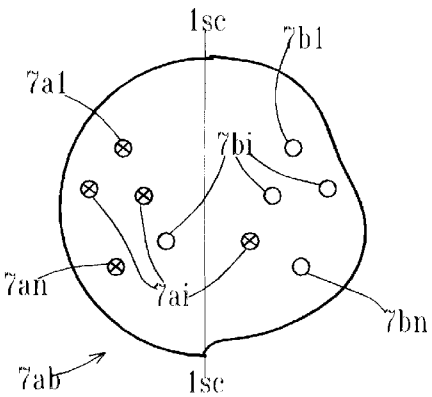
FIG. 11 is a schematic illustration of the front view of an electric coupling device of a general type to be installed at the front end of the coupling apparatus of FIGS. 1.

In many situations, automatic coupling of two adjacent rail-cars' electric lines may also be necessary in addition to the automatic coupling of the cars' pneumatic line, and it would be ideal if such an electric connection can be integrated with the pneumatic coupling system described herein. Again, in order to be consistent with the standard of freight car industry, the electric coupler and its oppositely facing coupling counterpart should be substantially identical. FIG. 11 is a schematic illustration of the front coupling component of an electric coupler 7*ab* of a general type, according to the present invention, to be installed at the two ends of a rail-car 4 (FIGS. 1). In FIGS. 11–12, the line 1sc—1sc represent the central and longitudinal symmetry plane of the rail-car 4. As shown, the electric coupler 7*ab* has a plurality of male coupling elements 7*bl* . . . , 7*bn,* with each or every of the male element represented in general by the number 7*bi,* and with the letter n being the total number of electric lines to be connected. For each such male coupling elements 7*bi,* there is a corresponding female-receptacle element 7*ai* on the same coupling device 7*ab,* and the positions of the male 7*bi* and the female 7*ai* are symmetric with respect the symmetry plane 1sc—1sc of the car 4. For example, the female receptacle 7*al* should be at the mirror position of the corresponding male coupling element 7*bl* with respect to the mirror plane 1*sc*—1*sc.* However, it is not necessary for all the male coupling elements to be on one side of the plane 1sc—1sc and all the females on the other side, and the contour or the base frame of the coupler 7*ab* does not have to be symmetric with respect to the plane 1sc—1sc; In addition, it is also not necessary for all the male and female coupling elements 7*bi* and 7*ai* being installed on the same base frame. However, the total number of command- or signal-transmission lines shall be equal to the total number of male (or female) coupling elements n instead of 2*n,* and each male coupling member 7*bi* shall be electrically connected with its corresponding female 7*ai* on the same coupling device 7*ab.*

Referring now to FIG. 12, there is shown that two identical electric coupling devices 7*ab* and 7*ab'* of FIG. 11 are installed at the ends of two adjacent rail-cars 4 and 4'. The devices 7*ab* and 7*ab'* have a 180-degree rotation symmetry with respect to the vertical axis through the middle point between them. After the coupling, the male coupling elements 7*bi* of car 4 will be engaged with the respective female receptacles 7*ai'* of car 4', and the male coupling elements 7*bi'* of car 4' will be engaged with the respective female receptacles 7*ai* of car 4. As shown in this figure, each male coupling element 7*bi* of the electric coupler 7*ab* is electrically connected to the female receptacle 7*ai* on the same coupler 7*ab* by a connection line 7*mi.* Each male-female pair 7*bi*-7*ai* of coupler 7*ab* is connected, via an independent connection line, to the electric/electronic system of the car 4. Similar electric wiring arrangements are applied to the identical electric coupling device 7*ab'* on the other end of the car 4 and on the car 4', as shown in the figure.

It is understood that FIGS. 11–12 display the arrangement requirements for electric-coupling devices of a general type to be installed at two ends of a rail-car. It is preferred that the electric coupling elements 7*bi* /7*ai* of FIGS. 11–12 are integrated with the above-described male/female mating heads 50/51 of FIGS. 8–9, and that the air pressure from the rail-car 4's brake line can be employed to provide close contact between the electric connectors 7*bi'* and 7*ai* during the coupling. As described above, the male mating head 50 of FIG. 8*b* is designed in such a way that electric coupling components can be installed at its rear portion by replacing the member 50*q*; and the female mating head 51 of FIG. 9*b* is designed in such a way that electric coupling components can be installed at its front portion by replacing the cylinder 51*t* it. According to the present invention, any of the above-described male and female mating heads of FIGS. 8–9 can be arranged to have the respective male and female electric-coupling elements included or installed, with examples shown in FIGS. 8*b*/8*f* and FIGS. 9*b*/9*f.*

Referring now to FIG. 8*f* and FIG. 9*f,* there is shown that a male pneumatic-electric mating head 50''' (FIG. 8*f*) is engaged with a female pneumatic-electric mating head 51''' (FIG. 9*f*). The pneumatic-coupling portions of the mating heads 50''' of FIG. 8*f,* other than its electric-coupling portions, including the arrangements for elements such as the conduit 50*a*", the juncture-sealing air ring 50*e,* the protection elements 50*k*/50*k*', the orifice bosses 50*t*/50*p* on the conduit 50*a,* and the airflow-guiding members 50*b* and 50*c*" within the conduit 50*a*", are the same as those of the male mating head of FIG. 8*b;* The annular sealing elements 50*q* of FIG. 8*b* is removed and replaces with a male electric-coupling structure 87 in FIG. 8*f*. The pneumatic-coupling portions of the female mating heads 51'41 of FIG. 9*f,* other than its electric-coupling portions, including the arrangements for the cylindrical cup 51*b*' and the check-valve structure within the cup 51*b*' which includes the elastomeric ball valve 51*d*", the spring 51*e*" and the valve seat 51*c*", are the same as the female mating head of FIG. 9*b*. The front cylinder 51*t* of FIG. 9*b* is replaced by a cylinder 51*t*' that has female electric-coupling elements 7*ai* installed in FIG. 9*f* As shown in the figure, the rear end of the cylinder 51*t*' is threaded onto the front half of the valve seat 51*c*". In order to protect its electric-coupling components, the male mating head 50'" of FIG. 9*f* is provided with a cylindrical protection cup 50*y* which is co-axial with the male conduit 50*a*" and secured to the front panel 14 of the box 6.

Figure 10C:
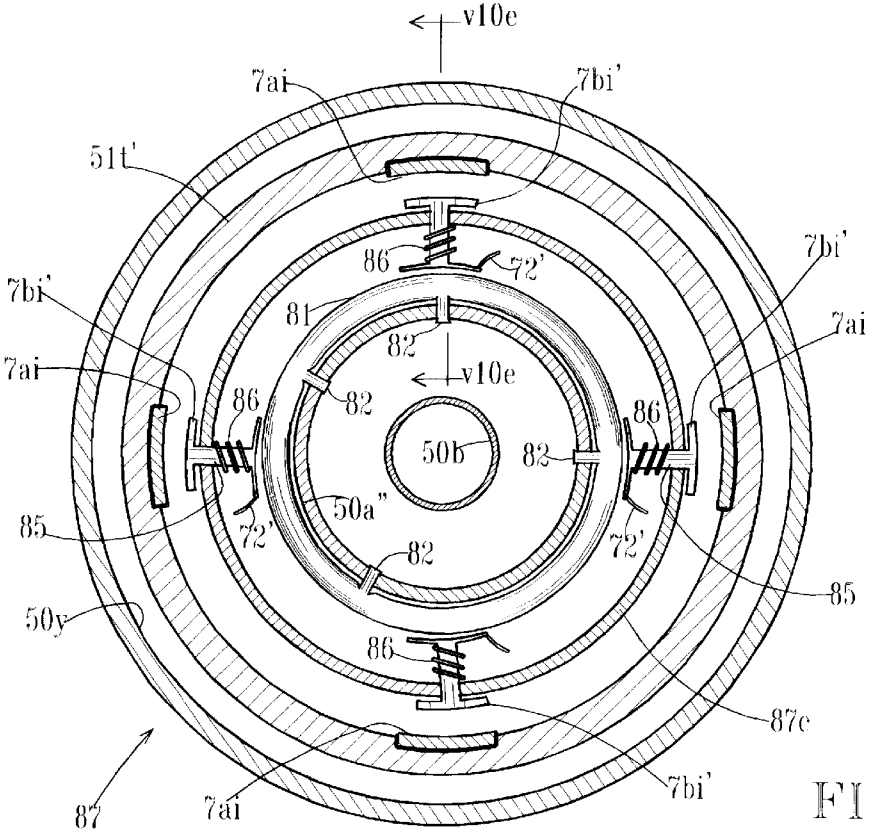
FIGS. 10*c*–10*e* are enlarged sectional view of the electric-coupling portion of the male and female mating heads of FIGS. 8*f* and 9*f,* 10*c* is a cross-sectional view taken along line v10c—v10c of FIGS. 8*f* and 9*f;* 10*e* is the sectional view taken along line v10e—v10e of FIG. 10*c,* which is also an enlarged view of the electric coupling portion of the male and female mating heads of FIGS. 8*f* and 9*f;* and 10*d* shows the male-mating portion of FIG. 10*e* when said male mating head is not engaged with the female mating head therein.
Figure 10D:
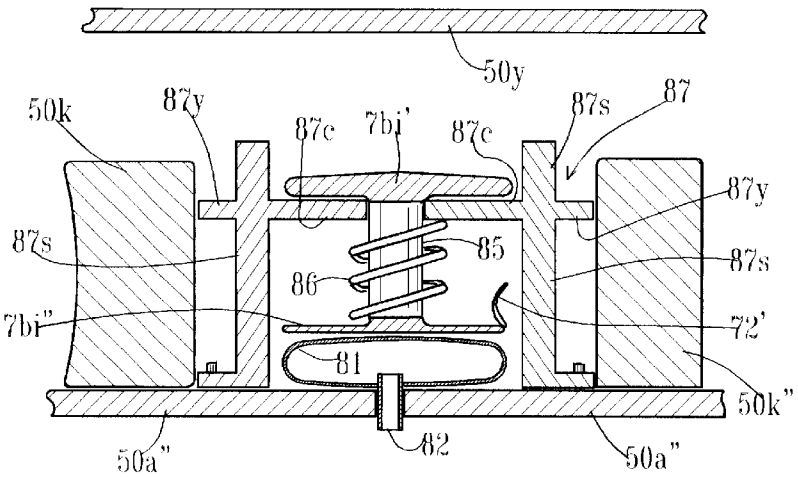
Figure 10E:
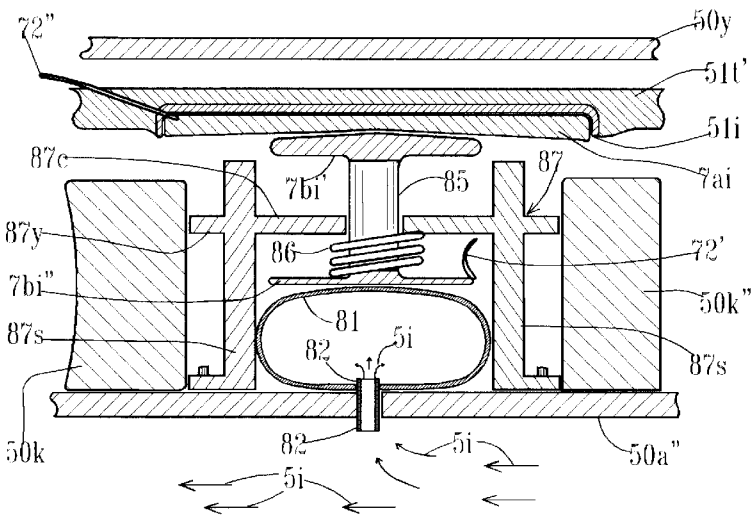

The cross-sectional view of the electric-coupling portion of the mating heads 50'" and 51'", taken substantially along line v10c—v10c of FIGS. 8*f*/9*f,* is shown in FIG. 10*c*, and the cross-sectional views taken along line v10e—v10e of FIG. 10*c,* which are also the enlarged views of the electric coupling portions of FIGS. 8*f*/9*f,* are shown in FIGS. 10*d*–10*e*. As shown in these figures, the electric coupling portion of the female mating head 51'" includes a plurality of female electric connectors 7*ai* permanently molded onto, and along the circumference of, the inner surface of the front portion of the cylinder 51*t*' with a layer of electrically-insulating materials 51*i* molded between the connector 7*ai* and the cylinder 51*t*'. An electric connection 72" covered with electrically-insulating materials is connected to the connector 7*ai,* passing across the cylindrical wall of the cylinder 51*t*' and the insulating layer 51*i,* as shown in the figures. The electric wire 72" leads to the electric cable 72 inside the box 6 (FIGS. 3–6).

The coupling counterparts of the aforesaid female connectors 7*ai* are a plurality of male electric connectors 7*bi'* received within, and along the circumference of, an electrically-insulating annular structure or frame 87. The annular insulating structure 87 is co-axial with the conduit 50*a*" of the male mating head 50'" and affixed or mounted onto the external of the conduit 50*a*" by any conventional fastening means such as screwing or molding or any other feasible means. The annular insulating frame 87 is situated at the position of the member 50*q* of FIG. 8*b* right behind the annular protection collar 50*k*. Another annular protection collar 50*k*" is disposed right behind the insulating structure 87 and affixed to the external of the conduit 50*a*" for protecting the member 87, as shown in the figure.

The annular insulating structure 87, having an H-shaped radial cross-section as shown in FIGS. 10*d*–10*e,* is cylindrically symmetric with respect to the axis of the conduit 50*a*. The insulating structure 87 includes a pair of annular side supports 87*s* and an annular crossbeam 87*c* between the two sides 87*s*. The crossbeam 87*c* has a front and a rear side-extensions 87*y* that extend beyond the two sides 87*s* and contact the protection collars 50*k* and 50*k''* respectively. In this way, the protection collars 50*k* and 50*k'* can prevent the member 87 from moving during the uncoupling process, as will be described later. Each of the male electric connectors 7*bi'* is received within the insulating structure 87 between its two sides 87*s* above the crossbeam 87*c,* as shown in FIGS. 10*d*–10*e*. Each male electric connector 7*bi'* has a metal compressing foot 7*bi*", which is received within the annular insulating frame 87 below the crossbeam 87*c,* and is electrically connected to a wire connection 72' that leads to the electric cable 72 inside the box 6 (FIGS. 3–6). The male connector 7*bi'* and its compressing foot 7*bi*" are mechanically and electrically connected by a connection bar 85 which passes across the annular crossbeam 87*c* of the frame 87 via a through hole provided thereon. A compressing spring 86 is mounted on the connection bar 85 between the foot 7*bi*" and the inner side of the crossbeam 87*c,* as shown in the figures. Also situated within the inner portion of the frame 87 is an inflatable annular air ring 81, which is disposed under the compressing feet 7*bi*" and around the conduit 50*a,* i.e, the air ring 81 is situated between the conduit 50*a* and the members 7*bi*" of the male mating head 50'". The air ring 81 is pneumatically connected to the interior of the conduit 50*a* via a plurality of orifice bosses 82 around the conduit 50*a,* as shown in the figures. In FIG. 8*b,* air leak from these orifices 82 is blocked by the annular members 50*q* provided therein.

It is understood that the principle of the electric coupling mechanism described herein is to employ the pneumatic system's pressure for maintaining closed contact between the male and female electric connectors 7*bi'* and 7*ai* when the male mating head 50'" of FIG. 8*f* is engaged with the female mating head 51'" of FIG. 9*f* When the male mating head 50'" is not engaged with the female mating head 51'", as shown in FIG. 10*d*, there is no air pressure in the conduit 50*a*"; and the male connector 7*bi'*, together with the members 7*bi*" and 85, will be biased by the spring 86 to its lowest position with the connector 7*bi*' resting on and supported by the crossbeam 87*c* of the annular insulating frame 87. When the male mating head 50'" is engaged with the female mating head 51'", as shown in FIG. 10*e,* the large pressure in the air ring 81 will compress the male electric connector 7*bi'* of the male head 50'", via the members 7*bi*" and 85, against the female electric connector 7*ai* of the female mating head 51'" and against the compressing force from the spring 86. Again, the arrows 5*i* in the figure indicate the direction of the airflow. The brake-line pressure of a freight train is relatively large. Such a pressure, while transferred in to the air ring 81, will present a relatively large force between the male and female electric connectors 7*bi'* and 7*ai*. So it is appreciated that such an electric coupling mechanism is very reliable. However, during the uncoupling process, the large forces between the male and female connectors 7*bi'* and 7*ai* will cause large friction force between them. Such a friction force will tend to move the insulator frame 87 from its position on the conduit 50*a,* which is why the protection members 50*k* and 50*k*" are provided, as described above. Since the electric coupling components 7*bi'* are very sensitive to wet environment such as when it rains, the protection cup is 50*y* provided, as described above.

In addition to their application in freight car coupling processes as described above, the devices shown in FIGS. 8–9 can also be applied in other pneumatic and/or electric coupling fields. So the air hoses 52 and 52' in FIGS. 8–9 may be understood as representing, generally, any two pneumatic systems to be connected. It is understood that any of the male mating heads of FIGS. 8*a*–8*d* can be coupled or combined with any of the female mating heads of FIGS. 9*a*–9*d*. In some situations other than railroad freight-car coupling, it is not necessary to have two identical couplers installed onto the two pneumatic/electric systems to be coupled. In such cases, instead of using a pair of male and female heads on each side, the male coupler of FIGS. 8 can be installed at one side of the pneumatic/electric systems to be coupled, and the female coupler of FIGS. 9 at the other side.

Referring now to FIGS. 13–18 in conjunction with FIGS. 1, there is shown the installation portion 7 of the coupling system 5 of the present invention. As described above, the installation portion 7 of the coupling system 5 includes a front shank-support assembly 97 for supporting the front portion 80*f* of the coupler shank 80, a rear shank-support assembly 93 for supporting the rear portion 80*r* of the coupler shank 80, and a coupling-position-control assembly 191 for urging the front mating assembly 6, via the coupler shank 80, to its front-most position for maintaining close contact with its coupling counterpart on an adjacent car.

Figure 16A:
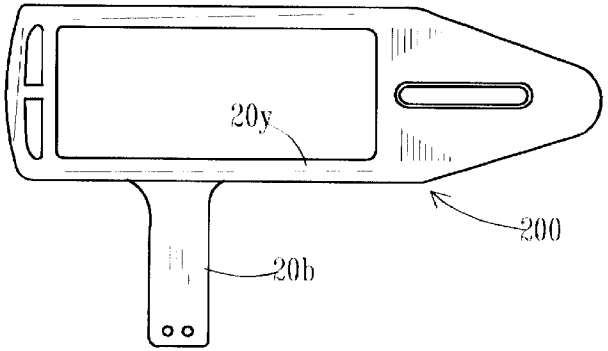
FIGS. 16 are fragmentary lateral elevation views showing the upper portion of the coupling-position-control assembly of the pneumatic-electric coupling system of FIGS. 1, which is associated with the yoke of the conventional draft assemblies within the center sill of a railroad car.
Figure 16B:
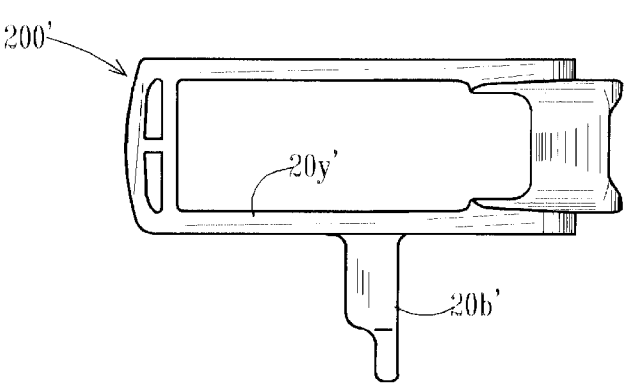
Figure 13:
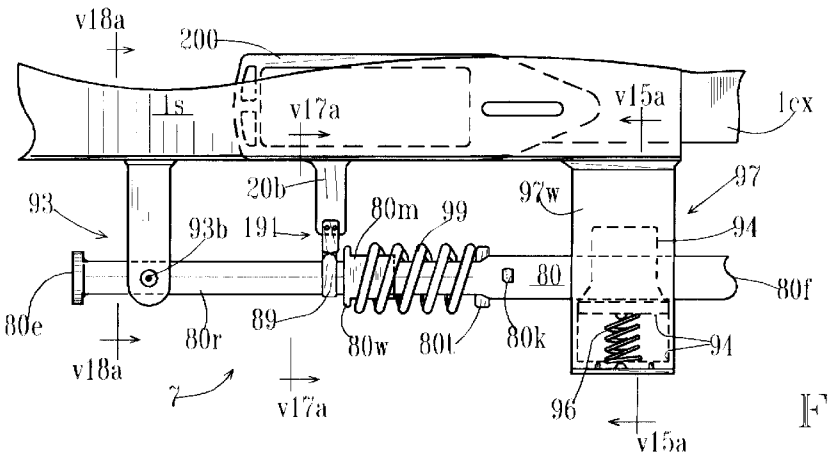
FIG. 13 is a fragmentary side elevation view, to an enlarged scale, of the installation portion of the pneumatic-electric coupling system of FIG. 1*a*.
Figure 17B:
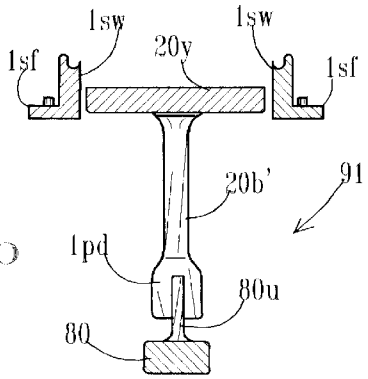
FIG. 17*b* is a sectional end view showing an alternate arrangement of the coupling-position-control assembly of the pneumatic-electric coupling system of FIGS. 1.
Figure 17A:
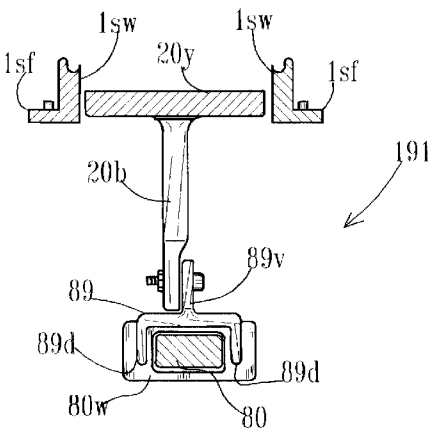
FIG. 17*a* is a sectional end view, taken along line v17a—v17a of FIG. 13, showing the preferred embodiment of the coupling-position-control assembly of the pneumatic-electric coupling system of FIGS. 1.

As shown in FIG. 13, FIGS. 16, and FIG. 17*a,* the upper portion of the preferred embodiment 191 of the coupling-position-control assembly is a rigid vertical spline 20*b* affixed to the bottom of the lower strap 20*y* of the commonly-used yoke casting 200. The yoke casting 200 is a standard component of the well-known conventional draft assembly situated within the center sill 1*s* of the railroad car 4. Preferably, the yoke 200 is an AAR-standard yoke for receiving standard Type-E or Type-F coupler, as shown in FIGS. 16*a*–16*b* respectively. The lower portion of the coupling-position-control assembly 191 includes a movable flanged shank-sleeve 80*m* mounted on the coupler shank 80, a compressing spring 99 mounted on the coupler shank 80 in front of the sleeve 80*m,* and a fork 89 secured to the lower bottom of the aforesaid vertical spline 20*b* next to and behind the rear end of said sleeve 80*m.* The shank-sleeve 80*m* can slide or is movable along the coupler shank 80, and has a flange 80*w* at its rear end for compressing the spring 99 forwardly. The spring 99 is partially surrounding the front portion of the shank-sleeve 80*m.* As shown in FIG. 17*a,* the fork 89 comprises an upper shaft 89*v* and a reversed-U-shaped lower portion that has two legs 89*d.* The upper shaft 89*v* of the fork 89 is affixed to the lower end of the vertical spline 20*b* by means of bolting, or screwing or welding or conventional feasible fastening means. The length of the vertical spline 20*b* shall be appropriate so that the coupler shank 80 is disposed between the two legs 89*d* of the fork 89 from underneath.

As shown in FIG. 13, at least one spring-limit tab 80*t* is affixed to the coupler shank 80 at an appropriate position for preventing the spring 99 from sliding forwardly beyond the position of the tab 80*t.* Also affixed to two sides of the coupler shank 80, at an appropriate position, are a pair of shank-stop lugs 80*k* for providing limitation to the front-most position of the coupler shank 80. In this way, the rear end of the spring 99 will compress the rear flange 80*w* of the shank-sleeve 80*m* against the fork 89 and the vertical spline 20*b;* and the front end of the spring 99 will compress the tabs 80*t* and push the coupler shank 80 forwardly, urging the lugs 80*k* of the coupler shank 80 against the front shank-support assembly 97. The purpose of the arrangement described herein is to use the position of the York 200 to push forward the coupler shank 80 so that the front mating assembly 6 of the coupling system 5" can always maintain close contact with its coupling counterpart of an adjacent car. Alternatively, the shank-stop mechanism provided by the lugs 80*k* against the front shank-support assembly 97 can be replaced by a wider collar 80*e* or the like attached to the rear end of the shank 80 against the rear shank-support assembly 93 from behind if the length of the shank 80 is chosen properly.

Referring now to FIGS. 17*b* and 1*c,* there is shown the second preferred embodiment 91 of the coupling-position-control assembly of the coupling system 5 of the present invention. As shown in the figure, the coupling-position-control assembly 91 include a vertical shank-limit stop 80*u* affixed to the top of the coupler shank 80 at an appropriate position and a rigid vertical spline 20*b*' secured, at an appropriate position, to the bottom of the lower strap 20*y* of the yoke 200 next to and behind the member 80*u*. Again, the York 200 is a standard component of the well-known conventional draft assembly within the center sill 1*s* of the railroad car 4. The purpose of providing the members 80*u* and 20*b*' described herein is to use the position of the York 200 to push forward the coupler shank 80 so that the front mating assembly 6 of the coupling system 5" can always maintain close contact with its coupling counterpart of an adjacent car, which is similar to the arrangement of FIG. 13 and FIG. 17*a* except that the spring-cushion mechanism provided therein is not included. Preferably, as shown in FIG. 17*b*, the vertical spline 20*b*' has wider lower portion 1*pd* in order to insure appropriate contact between the two members 20*b*' and 80*u.*

Figure 18A:
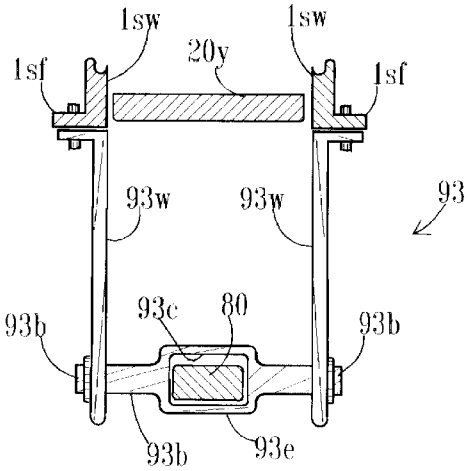
FIG. 18*a* is an sectional end view, taken along line v18a—v18a of FIG. 13, showing the preferred embodiment of the rear shank-support assembly of the pneumatic-electric coupling system of FIGS. 1.

Referring now to FIG. 18*a* in conjunction with FIG. 13 and FIG. 1*a,* there is shown a preferred rear-shank-support assembly 93. As shown in the figures, the rear-shank-support assembly 93 includes two side supports 93*w* secured to the two side flanges 1*sf* of the center sill 1*s*'s two side walls 1*sw*. The structure and dimensions of the center sill 1*s* of a freight car is well known and is standardized. The rear shank-support assembly 93 further includes a crossbeam 93*b* that is parallel to the sleeper or tie of the railroad and affixed to the lower end of the two sides 93*w.* The central portion 93*e* of the crossbeam 93*b* is substantially wider and has a through-bore or passage 93*c* that is parallel to, and has the similar but larger cross-sectional shape of, the rear portion of the coupler shank 80, as shown in the figures. The rear portion 80*r* of the coupler shank 80 passes across the passage 93*c* at the middle of the crossbeam 93*b* and is supported by the rear-support assembly 93.

It is appreciated that the principle of introducing coupling-position-control assemblies 191 or 91 described above in the installation portion 7 of the coupling system 5 of the present invention is to use the yoke 200 within the center sill is of the rail-car 4 to provide appropriate control of the coupling positions of the front-mating assembly 6 when there is draft load on the mechanical coupling device 900 of the car 4. In the first preferred coupling-position-control assembly 191 of FIG. 1*a,* FIG. 13, and FIG. 17*a*, there is a cushion mechanism, provided by the spring 99, between the vertical spline 20*b* and the coupler shank 80. The second preferred coupling-position-control assembly 91 of FIG. 1*c* and FIG. 17*b* does not have such a cushion mechanism. Because of this, it is preferred, in regarding the rear installation portion 7' of the coupling system 5" of FIG. 1*c,* that a compression spring 99' is mounted on coupler shank 80 and positioned right in front of the rear shank-support assembly 93. The rear shank-support assembly 93 of the coupling system 5" of FIG. 1*c* can be the same as that of the coupling system 5 of FIG. 1*a*. However the compressing spring 99' is mounted on the coupler shank 80 in front of and next to the crossbeam 93*b* of the rear shank-support assembly 93. Certainly, a spring-limit tab 80*t* and a shank-stop lugs 80*k* shall be attached to the shank 80 at their respective appropriate positions, as shown in FIG. 1*c,* so that the spring 99' will urge the front-mating assembly 6 of the coupling system 5, via the shank 80, to its front-most position with the shank-stop lugs 80*k* against the front shank-support assembly 97".

Alternatively, the above-described coupling-position-control assemblies 191 and 91 of FIG. 17*a*/FIG. 1*a,* and FIG. 17*b*/FIG. 1*c* respectively can be combined or integrated into the rear shank-support assembly 93 of FIG. 18*a* and FIGS.

Figure 18C:
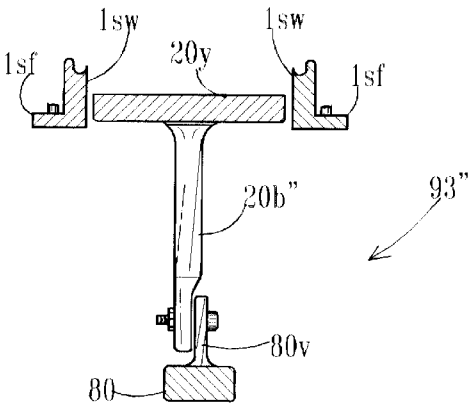
FIGS. 18*b* and 18*c* are sectional views showing the alternate arrangements of the rear shank-support assembly of the pneumatic-electric coupling system of FIGS. 1.
Figure 18B:
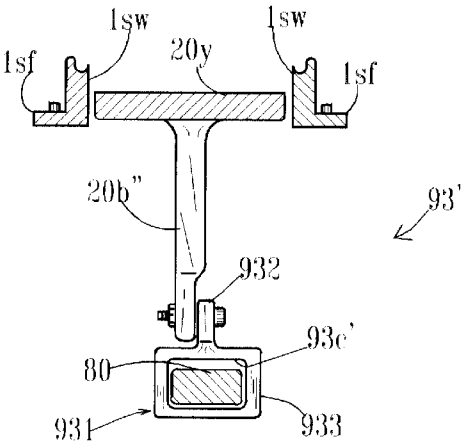

1, with an example shown in FIGS. 1*b* and 18*b*. As shown in this two figures, the combined position-control and rear-support assembly 93' of the coupling system 5' is installed near the rear end of the coupler shank 80. The assembly 93' includes an upper rigid vertical spline 20*b*" affixed to the bottom of the lower strap 20*y* of the yoke 200 and a rectangular shank-support casting 931. The shank-support casting 931 comprises an upper shaft 932, which is attached to the lower end of the vertical spline 20*b*", and a lower rectangular portion 933 that has a through-bore or passage 93*c*' that is parallel to, and has the similar but larger cross-sectional shape of, the rear portion 80*r* of the coupler shank 80. The coupler shank 80 passes across the passage 93*c*' of the shank-support casting 931 and is supported by the assembly 93'. Similar to the arrangements of FIGS. 1*a* and 1*c*, a compressing spring 99' is mounted onto the rear portion 80*r* of the coupler shank 80 in front of, next to, and against the lower member 931 of rear-support assembly 93' in FIG. 1*b*. A spring-limit tab 80*t* is attached to the coupler shank 80 at an appropriate position in front of the spring 99'. In this way, the yoke 200 will, via the vertical spline 20*b*", the casting 931 and the spring 99', urge the front-mating assembly 6 of the coupling system 5' to its front-most position regardless of the relative car-chassis movement caused by the draft and buff load on the mechanical coupler 900 of the car 4.

Another alternate arrangement is to have the rear portion 80*r* of the coupler shank 80 attached, via a vertical tab 80*v* welded on to the top of the shank 80, directly onto the vertical spline 20*b*" which is affixed to the bottom of the lower strap 20*y* of the yoke 200, as shown in FIG. 18*c*. In this case, the compressing spring 99' of FIG. 1*b* is not necessary, since the position of the front-mating assembly 6 is directly controlled by the position of the yoke 200 via the coupler shank 80 and the vertical spline 20*b*".

Figure 14B:
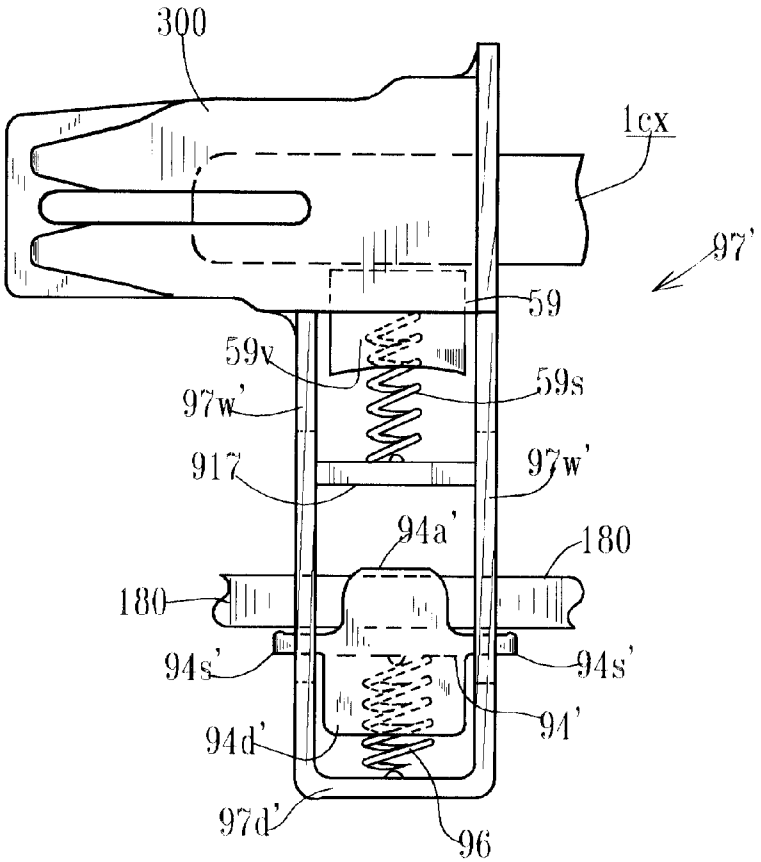
FIG. 14*b* is a side elevation view taken along line v14b—v14b of FIG. 14*a*.
Figure 14A:
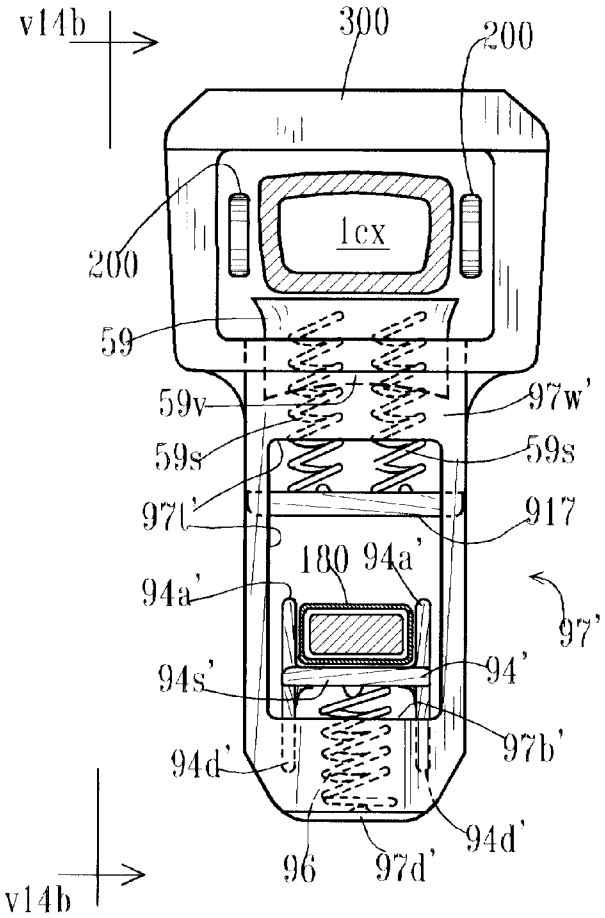
FIG. 14*a* is an enlarged end view, taken along line v14a—v14a of FIG. 1*d*, showing the first preferred embodiment of the front shank-support assembly of the pneumatic-electric coupling systems of FIGS. 1.
Figure 14C:
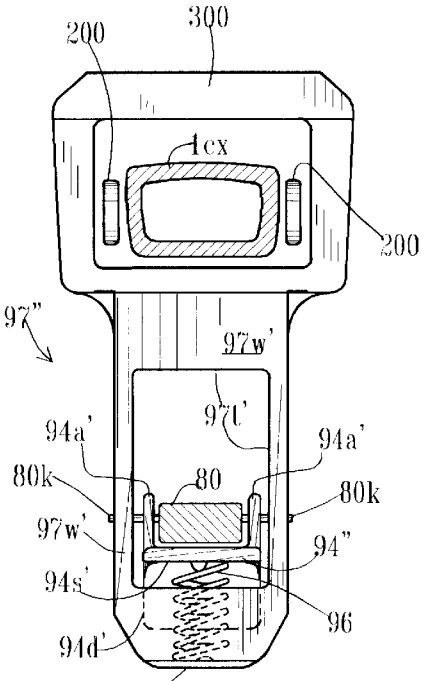
FIG. 14*c* is an enlarged end view, taken along line v14c—v14c of FIG. 1*c,* showing the second preferred embodiment of the front shank-support assembly of the pneumatic-electric coupling systems of FIGS. 1.

Referring now to FIGS. 14*a*–14*b* and 14*c* in conjunction with FIG. 1*d*, there is shown, respectively, the first and second preferred front shank-support assembly 97' of the pneumatic-electric coupling system of the present invention. As shown in these figures, the upper portion of the front shank-support assembly 97' is the striker 300, which is the well-known standard component of the conventional draft assembly situated at the front end of the center sill is of the railroad car 4. Preferably, the striker 300 is an AAR-standard striker for receiving standard Type-E or Type-F coupler. The front shank-support assembly 97' further includes a pair of substantially identical front and rear erect walls 97*w*' affixed to the bottom of the striker 300 with a bottom support 97*d*' connected between the two walls 97*w*' at their bottom ends. Each of the two erect walls 97*w*', which is perpendicular to the coupler shank 80, has a rectangular opening 97*t*' with appropriate width and length for receiving the coupler shank 80.

The lower portions of the two erect walls 97*w*' and the bottom support 97*d*' form a pocket, in which receives a shank-support casting 94'. The casting 94', having an H-shaped cross-section, comprises a pair of upper upstanding side arms 94*a*', a pair of flat side feet 94*d*', and a crossbeam 94*s*' at the middle. The two flat feet 94*d*' of the casting 94' may be parallel or perpendicular to the shank 80, as shown in FIGS. 14*a* and 14*c* respectively. The two upper arms 94*a*' and the crossbeam 94*s*' of the shank-support casting 94' form a topless channel or passage in which receives and supports the coupler-shank channel 180 (FIG. 1*d*). It is preferred that the front and rear ends of the crossbeam 94*s*' extend beyond the front and rear erect walls 97*w*' of the assembly 97' via the respective openings 97*t*' of the walls 97*w*', and that the width of the front and rear ends of the crossbeam 94*s*' is the same as or slightly smaller than the width of the opening 97*t*' of the walls 97*w*'. The dimension and position of the casting 94' shall be arranged in such a way that the lowest position of the shank-support casting 94' is limited by the lower edge 97*b*' of the opening 97*t*' of the walls 97*w*' against the member 94*s*' of the casting 94' from underneath, and that the left-right movement of the casting 94' is restricted by the two sides of the opening 97*t*' of the walls 97*w*' against the sides of the crossbeam 94*s*'. The dimension of the two feet 94*d*' of the casting 94' shall be arranged in such a way that its longitudinal width is the same as or slightly smaller than the distance between the front and rear erect walls 97*w*' of the assembly 97' so -that the back and forth movements of the casting 94' are restricted by the two erect walls 97*w*' against the front and rear edges of the two feet 94*d*' of the casting 94'.

As shown in the figures, a compressing spring 96 is disposed between the crossbeam 94*s*' of the casting 94' and the bottom support 97*d*' of the assembly 97'. It is noticed that the pocket, in which receives the spring 96, is formed by the front and rear erect wall 97*w*' and the bottom support 97*d*' of the assembly 97', and by the crossbeam 94*s*' and the left and right feet 94*d*' of the casting 94'. It is now appreciated that the direct shank-support elements 94' and the spring 96 of front shank-support assembly 97' provide the coupler shank 80 and hence the front-mating assembly 6 of the coupling system 5 with a vertical cushion mechanism and limited moving freedom in vertical direction. Such vertical cushion is necessary for facilitating the vertical alignment process during the coupling, which is provided by the elements 40 and 44 of the front-mating assembly 6, as described above in conjunction with FIGS. 1–7.

In some situation, the shank 1*cx* of the conventional coupler 900 also needs to be provided with a vertical cushion mechanism. Such a cushion mechanism can be installed to the upper portion of the shank-support assembly 97' described herein underneath the striker 300, as shown in FIGS. 14*a*–14*b*. In the figures, a middle support plate 917 is affixed to, and is disposed between, the front and rear erect walls 97*w*' at an appropriate position. The shank 1*cx* of the conventional coupler 900 rests on the top plane surface of a casting 59. The lower interior of the casting 59 is a hollow 59*v* in which receives at least one compressing spring 59*s*. The lower end of the spring 59*s* is supported by the member 917. It is now appreciated that the cushion mechanism introduced by the spring 59*s* provide the conventional coupler 900 with limited moving freedom in vertical direction. Alternatively, such a cushion mechanism of spring 59*s* may not be necessary. If so, the elements 59, 59*s*, and 917 of the front shank-support assembly 97' of FIGS. 14*a*–14*b* may not be included, as shown in FIGS. 14*c* and 1*c*. Other portions of the assembly 97" of FIG. 14*c* are the same as those of FIGS. 14*a*–14*b*. It is also appreciated that only the shank-support casting 94'/94", which can be removed from the front shank-support assembly 97'/97" for repairing, has direct contact with the coupler shank 80; and there is no direct contact between the coupler shank 80 and any portion of the erect walls 97*w*' which may be permanently affixed to the striker 300.

Figure 15B:
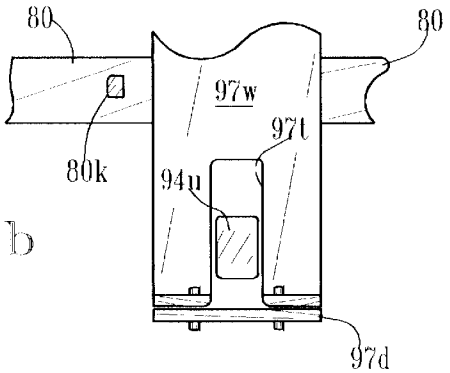
FIG. 15*b* is a lateral elevation view taken along line v15b—v15b of FIG. 15*a*.
Figure 15A:
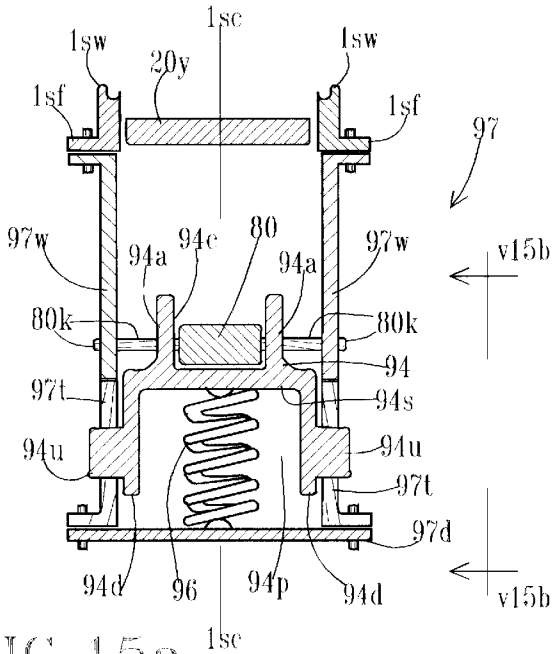
FIG. 15*a* is a sectional view, taken along line v15a—v15a of FIG. 13, showing the third preferred embodiment of the front shank-support assembly of the pneumatic-electric coupling system of FIGS. 1.

Certainly, there are various ways of modifying the front shank-support assembly 97' described above. Referring now to FIGS. 15*a*–15*b* in conjunction with FIG. 13, there is shown the third preferred embodiment 97 of the front shank-support assembly of the coupling system 5 of the present invention. As shown in these figures, the assembly 97 includes a pair of left and right erect support side walls

97*w* secured to the respective sidewall flanges 1*sf* of the center sill 1*s*. A bottom support 97*d* is affixed to the bottom ends of the side-walls 97*w*. The erect walls 97*w* are parallel to the longitudinal axis of the rail-car 4. Each of the two walls 97*w* has an elongated vertical slot 97*t* with appropriate width and length at its middle lower end. A coupler-shank-support casting 94 is received at the lower portion of the assembly 97 above the bottom support 97*d*.

As shown in FIG. 13 and FIGS. 15*a*–15*b*, the shank-support casting 94, having an H-shaped cross-section, includes a pair of upper upstanding side arms 94*a*, a pair of flat side feet 94*d* parallel to the coupler shank 80, and a crossbeam 94*s* at the middle. Alternatively, the two feet 94*d* of the casting 94 can be perpendicular to the shank 80. The two upper arms 94*a*' and the crossbeam 94*s* of the shank-support casting 94' form a topless passage or channel in which receive and support the coupler shank 80. The casting 94 has a pair of rectangular ears 94*u* at the external sides of its two feet 94*d*. A compressing spring 96 is disposed between the crossbeam 94*s* of the casting 94 and the bottom support 97*d* of the assembly 97, as shown in the figures.

It is preferred that lower portion of the shank-support casting 94, not including the two ears 94*u*, shall just fit into the bottom space between the two side walls 97*w* of the assembly 97. It is also preferred that the length and width of the feet 94*d* of the shank-support casting 94 are larger than the width and thickness of the ears 94*u*, and that the ears 94*u* of the casting 94 shall just fit into and the elongated slot 97*t* of the side walls 97*w*. These arrangement shall be in such ways that the moving of the shank-support casting 94 in vertical direction is limited by the length of the slot 97*t* on the side walls 97*w* against the ear 94*u* of the casting 94, the movement of the casting 94 in longitudinal direction is restricted by the slot 97*t* against the ear 94*u* of the casting 94, and the left/right movement of the casting 94 is restricted by the side walls 97*w* of the shank-support assembly 97 against the lower portion of the shank-support casting 94. It is appreciated that the spring 96 of the front shank-support assembly 97 provide the coupler shank 80, and hence the front-mating assembly 6, with cushion mechanism and limited moving freedom in vertical direction.

Figure 15C:
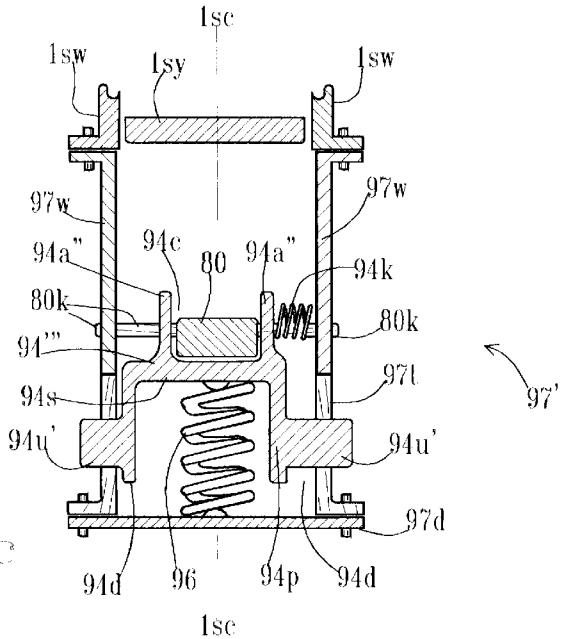
FIG. 15*c* is a sectional view showing the forth preferred embodiment of the front shank-support assembly of the pneumatic-electric coupling systems of FIGS. 1.

Alternatively, the front shank-support assembly 97 described herein can be arranged to provide the coupler shank 80 with left-right moving freedom, as shown FIG. 15*c*. Such a left-right moving freedom may be necessary to facilitate the horizontal alignment process described above during the coupling. In this case, the lateral width of the shank-support casting 94''' shall be made smaller, compared with that of FIG. 15*a*, to provide the casting 94''' with desired left-right movement between the two side walls 97*w*, and the two ears 94*u*' of the casting 94''' of FIG. 15*c* shall be made longer so that they are always received within the slot 97*t* of the side walls 97*w* during such left-right movement of the casting 94. In order to control the default position of the shank-support casting 94, a compressing spring 94*k* is disposed between one of the side walls 97*w* and one of the upper upstanding arm 94*a*" of the casting 94 at the same side. At default condition when there is no external force on the coupler shank 80, which is disposed between the two upper arm 94*a*' and 94*a*" of the casting 94''', the casting 94''' will be biased by the spring 94*k* to one side with one of its lower side feet 94*d* against one of the side walls 97*w* at its side. It is preferred that the shank-support casting 94''' is arranged in such a way that, at the aforesaid default condition, the coupler shank 80 is at the middle position between the two side walls 97*w*.

It is understood that it will take at least several years to have most of the freight cars equipped with the automatic pneumatic-electric coupling system of the present invention. So there is an interface problem when a new car 4 equipped with the pneumatic-electric coupling system of the present invention is to be coupled with a car that only has manually-operated pneumatic-electric coupling devices installed. The solution for such an interface problem is to provide the new car 4 with both automatic and manual coupling devices. Manually-operated electric coupling device can be connected to electric cable of car 4 in parallel with the cable 72*x* (FIGS. 1–3) which leads to cable within the front-mating assembly 6, and the parallel-connection arrangement thereto and the embodiment of manual electric coupler for rail-cars are well known to those in the art.

There are various ways of adding an manually-operated pneumatic coupling device in conjunction with the automatic pneumatic coupling system of the present invention. For example, in FIG. 1*c*, a manual coupler 56*c* is attached to the external end of the hose 54*a*" which leads to the pneumatic system within the box 6, and another manual coupler 56*c* is attached to an end of the hose 56 which connects to the brake line 56*x* of the car 4 via a stop cock 56*h*. The coupler 56*c* and the stop cock 56*h* are the well-known manually-operated devices installed at two end of the brake lines of existing rail-cars. If the two adjacent cars to be coupled are both equipped with automatic coupling system 5 of the present invention, the brakeman can just connect the manual coupler 56*c* of the hose 56 to the manual coupler 56*c* of the hose 54*a*" of the respective cars, otherwise, brakeman can perform the conventional manual air-hose-coupling procedure for connecting the manual coupler 56*c* of the hose 56 to the manual coupler of the adjacent car.

Another way of solving the aforesaid interface problem is to provide an auxiliary hose 56*b* for manual operation. As shown in FIGS. 1*a*–1*b*, the auxiliary hose 56*b* has the commonly-used manual pneumatic coupler 56*c* attached to its end and is connected to the brake line 56*x* of the car 4 via the commonly used stop cock 56*h*. The hose 56, which leads to the front mating assembly 6 of the coupling system 5, is connected to the brake line 56*x* via a Tee 56*t* for directing the air to the hose 56. As known to those in the art, the commonly-used stop cock 56*h* has a manual-operation handle 56*p* that has an "open" or "connect" position and a "close" or "disconnect" position. It is understood that the interface arrangement of FIGS. 1*a*–1*b* is only feasible if the front-mating assembly 6 of the automatic coupling system 5 is provided with the hose-end-sealing feature (FIGS. 5–6). During the coupling process, if the adjacent car is not equipped with automatic coupling system 5 of the present invention, the brakeman can simply perform the conventional manual air-hose-coupling procedure for connecting the manual coupler 56*c* of the hose 56 to the manual coupler of the adjacent car. The brakeman does not need to worry air leak at the automatic coupling component 6 because of the hose-end-sealing mechanism provided therein. If the adjacent car is equipped with automatic coupling system 5 of the present invention, the brakeman can simply turn the handle 56*p* of the stop cock 56*h* to the "close" position so that the airflow can be directed only to the hose 56 from the brake line 56*x*.

Alternatively, as shown in FIG. 1*d*, a three-way pneumatic switch 56*ht* can be used to replace the stop cock 56*h* and the Tee 56*t* of FIG. 1*a*. The three-way pneumatic switch 56*ht* has three ports, one is connected to brake line 56*x*, one to the auxiliary hose 56*b*, and the third one to the hose 56 that leads to the box 6 of the automatic coupling system 5 of the present invention. Similar to the arrangement of FIG. 1*a*, a manual coupler 56*c* is affixed to the other end of the hose 56. The pneumatic switch 56*ht* provided herein has a manual-operation handle 56*p* that has three positions, one is to connect the hose 56*x* to the hose 56 and block the connection between the hoses 56*x* and 56*b*, one is to connect the hose 56*x* to the auxiliary hose 56*b* and block the connection between the hose 56*x* and 56, and the third position is to disconnect the hose 56*x* from both the hoses 56*b* and 56. In this way, the brakeman can set the handle 56*p* to different positions depending on whether the adjacent car is installed with automatic coupling system of the present invention.

Naturally, the embodiment of the coupling devices used in the invention is not limited to the above-described examples. While certain novel features of this invention have been shown and described and are set out in the appended claims, it will be understood that various substitutions and changes in the forms and details of the devices described throughout this invention and in their operation can be made by those skilled in the art without departing from the spirit of the invention.

What is claimed is:

1. An automatic air-hose coupling system for installation at an end of the undercarriage of a railroad car and for coupling to a substantially identical counterpart coupling system, in oppositely facing relation therewith, of an adjacent car so as to pneumatically connect the train-line hoses of the two cars, said air-hose coupling system comprising, in combination, a rearwardly extending coupler shank parallel to the longitudinal axis of the car, a front-mating means, attached to the front end of said coupler shank, for engaging and pneumatically coupling with a front-mating means of said substantially identical counterpart coupling system, and a support portion for supporting said coupler shank so as to attach said front-mating means to the undercarriage of the railroad car, said front-mating means including, in combination, a substantially rectangular rigid housing structure, having a front-support panel, and a male and a female mating heads, mounted on said front-support panel of the rectangular housing structure and pneumatically connected to the train-line hose of the car, for engaging with, respectively, a female and a male mating heads of said substantially identical counterpart coupling system of the adjacent car, and for employing air pressure from the train-line hose of the respective car to automatically and pneumatically seal the coupling juncture of said engaging.

2. The automatic air-hose coupling system as set forth in claim 1, wherein said female mating head comprises a female cylindrical cup, mounted across said front-support panel at one side of a vertical symmetry plane of said rectangular housing structure, with the rear end thereof pneumatically connected to said train-line hose of the car, for receiving a male-engaging element of the male mating head of said counterpart coupling system, wherein said male mating head comprises, a male-engaging air conduit, mounted across said front-support panel at the side of said vertical symmetry plane opposite to that of said female cylindrical cup, with the rear end thereof pneumatically connected to said train-line hose of the car, for engaging with the female cylindrical cup of the female mating head of said counterpart coupling system and means for employing air pressure from said train-line hose to automatically seal the coupling juncture of said engaging.

3. The automatic air-hose coupling system as set forth in claim 2, wherein said male-engaging air conduit has a plurality of orifices at the cylindrical side thereof, wherein said means for employing air pressure comprises, an inflatable juncture-sea ling air ring mounted on and surrounding the front portion of said male-engaging air conduit, and means for pneumatically connecting said orifices of said male-engaging conduit to said juncture-sealing air ring, so as to transmit air pressure from said train-line hose to said air ring, such that said air ring is inflated against the interior cylindrical wall of said female cylindrical cup of the female mating head of said counterpart coupling system, while the two oppositely facing coupling systems of said two cars being coupled with one another, so as to seal said coupling juncture.

4. The automatic air-hose coupling system as set forth in claim 3, wherein said male mating head further includes air-flow guiding means situated within said male-engaging conduit for causing airflow to pass through said air ring, from the rear end of said male conduit and via said orifices thereon, before said airflow reaching the front end of of said conduit.

5. The automatic air-hose coupling system as set forth in claim 4, wherein said air-flow guiding means comprises a rear conical portion engaged with the interior cylindrical wall of said male-engaging conduit and a front outlet portion pneumatically engaged with at least one of said orifices of said male-engaging conduit.

6. The automatic air-hose coupling system as set forth in claim 3, wherein said male mating head further includes at least one annular protection collar means mounted on said male-engaging conduit adjacent to said air ring for protecting said air ring and for maintaining the position of the air ring during the coupling and uncoupling processes between said two coupling systems.

7. The automatic air-hose coupling system as set forth in claim 2, wherein said female mating head further includes one-way check-valve means situated within said female cylindrical cup for blocking passage of airflow from the rear end of the cylindrical cup to the front end thereof and allowing the passage of airflow in the opposite direction.

8. The automatic air-hose coupling system as set forth in claim 7, wherein said one-way check-valve means comprises, a valve head means situated within said female cylindrical cup, an annular valve seat, situated within said female cylindrical cup in front of said valve head means and engaged with the interior cylindrical wall of said cylindrical cup, for receiving said valve head means, and a compression spring means situated within said female cylindrical cup behind said valve head means for urging said valve head means against said valve seat so as to block the passage of airflow from the rear end of said female cylindrical cup to the front end thereof, and to allow the passage of airflow in the opposite direction.

9. The automatic air-hose coupling system as set forth in claim 2, wherein said male and female mating heads further include, respectively, male and female electric mating means for engaging with the respective female and male electric mating means of said counterpart coupling system so as to automatically connect the electric lines of said two cars.

10. The automatic air-hose coupling system as set forth in claim 9, wherein said male electric mating means includes a plurality of male electric-engaging elements electrically connected to the respective electric lines of said car and means for mounting said male electric-engaging elements around said male-engaging air conduit, and wherein said female electric mating means includes a plurality of female electric-engaging elements, electrically connected to the respective electric lines of said car and mounted at the respective appropriate positions on the interior cylindrical wall of said female cylindrical cup, for receiving and engaging with the respective male electric-engaging elements of said counterpart coupling system so as to connect the electric lines of said two cars.

11. The automatic air-hose coupling system as set forth in claim 10, wherein said male-engaging air conduit further comprises a plurality of orifices at the cylindrical side thereof, and wherein said male electric mating means further includes an inflatable annular air ring, mounted around said male-engaging air conduit and situated underneath said male electric-engaging elements, and pneumatically connected to said male-engaging conduit via said plurality of orifices, so as to employ the air pressure from said train-line hose to urge said male electric-engaging elements in radially esoteric direction against the respective female electric-engaging elements of said counterpart coupling system while the coupling systems of said two car being engaged with one another.

12. The automatic air-hose coupling system as set forth in claim 1, further comprising means for attaching said substantially rectangular housing structure to the front end of said coupler shank, including, pivot means for pivotally attaching said rectangular housing structure to said front end of the coupler shank such that said housing structure has limited horizontal rotation freedom with respect to said coupler shank, means for restricting the rotation range of said rotation, and biasing spring means for urging said housing structure toward its default position at which the vertical symmetry plane thereof is substantially parallel to the longitudinal axis of said car.

13. The automatic air-hose coupling system as set forth in claim 1, wherein said front-mating means further includes male and female alignment guiding means, affixed, respectively, to a first and a second sides of said substantially rectangular housing structure, for engaging with the respective female and male alignment guiding means of said counterpart coupling system so as to relatively align the front mating means of said two coupling systems and the male and female mating heads mounted thereon to their respective appropriate mating positions during the coupling process between said two coupling systems.

14. The automatic air-hose coupling system as set forth in claim 13, wherein said male alignment guiding means comprises a forwardly extending male alignment arm affixed to said first side of said substantially rectangular housing structure, and wherein said female alignment guiding means comprises a pair of substantially identical, oppositely facing, and forwardly extending rigid strips, with each said strip having an arc-shaped front portion and a straight rear portion, perpendicularly affixed to said second side of said substantially rectangular housing structure so as to take form of a longitudinal receiving channel with a substantially wider vertical front opening for receiving, vertically aligning, and engaging with the male alignment arm of said counterpart coupling system during said coupling process.

15. The automatic air-hose coupling system as set forth in claim 14, wherein said male alignment guiding means further includes a friction-reduction wheel, with the rotation axis thereof horizontally affixed to the front end of, and in perpendicular relation with, said male alignment arm, for reducing the friction between the male alignment arm and the female alignment guiding means of said counterpart coupling system during said coupling process.

16. The automatic air-hose coupling system as set forth in claim 14, wherein said female alignment guiding means further includes a cover plate affixed to the external edges of said two oppositely facing rigid strips so as to form a substantially rectangular longitudinal tunnel at said second side of said substantially rectangular housing structure for receiving the male alignment arm of said counterpart coupling system during said coupling process.

17. The automatic air-hose coupling system as set forth in claim 1, wherein said front-mating means further includes airflow control means situated within said substantially rectangular housing structure for blocking passage of airflow from said train-line hose to said male and female mating heads while the two oppositely facing coupling systems of said two cars being disengaged with one another and allowing said airflow passage while said two coupling systems being engaged with one another.

18. The automatic air-hose coupling system as set forth in claim 17, wherein said airflow control means includes, a cylindrical air-chamber means situated within said rectangular housing structure, including, a front portion pneumatically connected to said male and female mating heads, a rear portion pneumatically connected to said train-line hose, and valve seat means situated between said front and rear portions, a longitudinally movable piston shaft, with the rear end thereof situated within said rear portion of said cylindrical air chamber means, extending forwardly to the external front of said rectangular housing structure, passing through said front portion of said cylindrical air chamber means and across said front-support panel, having pneumatic sealing means provided thereto, piston valve mean, affixed to the rear end of said piston shaft and situated within said rear portion of said cylindrical air chamber means behind and adjacent to said valve seat means, for engaging with the valve seat means, and a compression spring situated within the rear portion of said air chamber means behind said piston valve means for urging the piston valve means against said valve seat means so as to block passage of airflow from said train-line hose to said male and female mating heads while said two oppositely facing coupling systems being disengaged with one another.

19. The automatic air-hose coupling system as set forth in claim 18, wherein said airflow control means is disposed such that the front portion of the piston shaft is at one side of a vertical symmetry plane of said rectangular housing structure, and wherein said front mating means further includes an external casting structure, affixed to the front-support panel of said rectangular housing structure at the side of said vertical symmetry plane opposite to that of said front portion of the piston shaft such that during the coupling process between said two coupling systems, said casting structure encounters and rearwardly urges the piston shaft of said counterpart coupling system against the respective compression spring to unseat the piston valve mean from the respective valve seat means.

20. The automatic air-hose coupling system as set forth in claim 1, wherein said front-mating means further includes cushion means for providing said front-support panel and the male and female mating heads mounted thereon with longitudinal cushion mechanism and limited longitudinal movement range with respect to said rectangular housing structure, including compression spring means for urging said front-support panel and the male and female mating heads mounted thereon to their respective front-most positions, so as to keep said mating heads in close contact with the respective mating heads of said counterpart coupling system.

21. The automatic air-hose coupling system as set forth in claim 1, wherein said support portion for supporting said coupler shank comprises, in combination, a front-support means for supporting the front portion of said coupler shank and a rear-support means for supporting the rear portion of said coupler shank.

22. The automatic air-hose coupling system as set forth in claim 21, wherein said front-support means includes, a shank-support casting structure, having a longitudinal channel at its top for receiving and supporting said coupler shank, said coupler shank being longitudinally movable with respect to said casting structure, and a casting-support structure, attached to the end of the undercarriage of said car from underneath, said casting structure being received at the lower portion of and supported by said casting-support structure such that it has limited vertical movement range with respect to said casting-support structure and that its longitudinal movement is restricted by said casting-support structure.

23. The automatic air-hose coupling system as set forth in claim 22, wherein said front-support means further includes a vertical compression spring means situated underneath said casting structure and supported by said casting-support structure for providing said casting structure and said coupler shank with vertical cushion mechanism.

24. The automatic air-hose coupling system as set forth in claim 22, wherein said front-support means further includes means for providing said casting structure with limited movement range in lateral direction perpendicular to the longitudinal axis of said car.

25. The automatic air-hose coupling system as set forth in claim 22, wherein said car is a conventional railroad freight car, having a standard center sill and a conventional draft assembly, with a conventional striker situated at each end of said center sill, and wherein said casting-support structure is affixed to said striker from underneath.

26. The automatic air-hose coupling system as set forth in claim 21, wherein said rear-support means includes, a shank receiving means, having a longitudinal tunnel at the central portion thereof, for receiving and supporting the rear portion of said coupler shank, said coupler shank being longitudinally movable with respect to said receiving means, and a rear supporting structure, with its top portion attached to the undercarriage of said car from underneath and at an appropriate position, and with said shank receiving means attached to its bottom portion so as to support said shank receiving means.

27. The automatic air-hose coupling system as set forth in claim 26, wherein said car is a conventional railroad freight car, having a conventional center sill and a conventional draft assembly, with a conventional yoke situated within and adjacent to each end of said center sill, said yoke having a lower strap, and wherein said top portion of said rear supporting structure is affixed to said lower strap.

28. The automatic air-hose coupling system as set forth in claim 26, wherein said car is a conventional railroad freight car, having a standard center sill with two side walls, each said side wall having a conventional lower side flange, and wherein said top portion of said rear supporting structure is affixed to said lower side flanges of said side walls from underneath.

29. The automatic air-hose coupling system as set forth in claim 1, wherein said car is a conventional railroad freight car, having a conventional center sill and a conventional draft assembly, with a conventional yoke situated within and adjacent to each end of said center sill, said yoke having a lower strap, and wherein said support portion for supporting said coupler shank includes means for utilizing the movement of said yoke for controlling the position of said coupler shank and said front-mating means so as to keep said front-mating means in close contact with the front-mating means of said counterpart coupling system while the two coupling systems of said two cars being coupled with one another.

30. The automatic air-hose coupling system as set forth in claim 29, wherein said means for utilizing includes, a compression spring coaxially and axially movably mounted on said coupler shank, with a spring stop situated at its front and affixed to said coupler shank for limiting the front-most position of said spring with respect to said shank, a flanged shank sleeve, coaxially and axially movably mounted on said coupler shank and disposed at the rear end of said spring, and a vertical thrust structure, including a top portion affixed to said lower strap and a lower engaging portion for engaging with said flanged shank sleeve so as to transfer the forwarding force from said yoke, via said shank sleeve and said compression spring, to said coupler shank and said front mating means.

31. The automatic air-hose coupling system as set forth in claim 1, further including, a conventionally used and manually operated pneumatic coupling device, and means for pneumatically connecting said train-line hose of the car to both said front-mating means and said manually operated coupling device such that said car can be pneumatically and manually coupled to a car only installed with manually operated pneumatic coupling device.

32. An automatic air-hose coupling system for installation at each end of the undercarriage of a railroad car and for coupling to a substantially identical counterpart coupling system, in oppositely facing relation therewith, of an adjacent car so as to pneumatically connect the train-line hoses of the two cars, said air-hose coupling system comprising in combination a front-mating means for engaging and pneumatically coupling with a front-mating means of said substantially identical counterpart coupling system of the adjacent car and means for supporting said front-mating means and attaching it to the respective end of the undercarriage of the car, said front-mating means including, a male and a female mating heads, pneumatically connected to the train-line hose of the car, for engaging with respectively a female and a male mating heads of said substantially identical counterpart coupling system of the adjacent car, and means for employing air pressure from the train-line hose of the respective car to automatically and pneumatically seal the coupling juncture of said engaging, said car being a conventional railroad freight car, having a conventional center sill and a conventional draft assembly with a conventional yoke situated within and adjacent to each end of said center sill, said yoke having a lower strap, said means for supporting including, a coupler shank means substantially parallel to the longitudinal axis of the car, with the front portion thereof attached to and supporting said front-mating means, a front-support means for supporting the front portion of said coupler shank means, and means for utilizing the movement of said yoke for controlling the position of said front-mating means via said coupler shank means and keeping the front-mating means in close contact with that of said counterpart coupling system while the two coupling systems of said two cars being coupled with one another.

33. The combination of claim 31, wherein said means for utilizing the movement includes, a compression spring coaxially and axially movably mounted on said coupler shank means, with a spring stop situated at its front and affixed to said coupler shank means for limiting the front-most position of said spring with respect to said shank means, a shank receiving means, disposed adjacent to the rear end of said spring, having a longitudinal tunnel at the central portion thereof for receiving the rear portion of said coupler shank means such that said coupler shank means is longitudinally movable with respect to the receiving means, and a vertical thrust means, including a top portion affixed to said lower strap and a lower engaging portion for engaging with said shank receiving means so as to transfer the forwarding force from said yoke, via said shank receiving means and said compression spring, to said coupler shank means and said front mating means.

34. The combination of claim 31, herein said front-support means includes, a shank-support casting structure, having a longitudinal channel at its top for receiving and supporting said coupler shank means, said coupler shank means being longitudinally movable with respect to said casting structure, and a casting-support structure, affixed to the respective end of the undercarriage of said car from underneath, said casting structure being received at the lower portion of and supported by said casting-support structure such that it has limited vertical movement range with respect to said casting-support structure, that its longitudinal movement is restricted by said casting-support structure, and that there is no direct contact between said coupler shank means and said casting-support structure.

35. The combination of claim 32, further including, a conventionally used and manually operated pneumatic coupling device, and means for pneumatically connecting said train-line hose of the car to both said front-mating means and said manually operated pneumatic coupling device such that said car can be pneumatically and manually coupled to an car only installed with manually operated pneumatic coupling devices.

36. The combination of claim 32, further including male and female electric mating means for engaging with the respective female and male electric mating means of said counterpart coupling system so as to automatically connect the electric lines of said two cars.

37. An automatic air-hose coupling system for installation at an end of the undercarriage of a conventional railroad freight car and for pneumatically coupling to a substantially identical counterpart coupling system in oppositely facing relation therewith . of an adjacent car so as to pneumatically connect the train-line hoses of the two cars, said air-hose coupling system comprising, in combination, a front-mating means, pneumatically connected to the train-line hose of the car, for engaging and pneumatically coupling with a front-mating means of said substantially identical counterpart coupling system of the adjacent car and means for supporting the front-mating means and attaching it to the undercarriage of the car, said conventional railroad freight car having a conventional center sill and a conventional draft assembly with a conventional yoke situated within and adjacent to each end of said center sill, said mean for supporting including means for utilizing the movement of said yoke for controlling the position of said front-mating means and keeping the front-mating means in close contact with that of said counterpart coupling system while the two oppositely facing coupling systems of said two cars being coupled with one another, said means for supporting further including a coupler shank substantially parallel to the longitudinal axis of the car, said front-mating means comprising, a substantially rectangular rigid housing structure attached to the front end of and supported by said coupler shank, and pneumatic mating means, mounted at the front portion of said rectangular housing structure and pneumatically connected to the train-line hose of the car, for engaging with the pneumatic mating means of said substantially identical counterpart coupling system of the adjacent car.

38. The combination of claim 37, wherein said front-mating means further includes male and female alignment guiding means, affixed, respectively, to a first and a second sides of said substantially rectangular housing structure, for engaging with the respective female and male alignment guiding means of said counterpart coupling system so as to relatively align the rectangular housing structure of said two coupling systems and the pneumatic mating means mounted thereon to their respective appropriate mating positions during the coupling process between said two coupling systems.

39. The combination of claim 37, further comprising means for attaching said substantially rectangular housing structure to the front end of said coupler shank, including, pivot means for pivotally attaching said rectangular housing structure to said front end of the coupler shank such that said housing structure has limited horizontal rotation freedom with respect to said coupler shank, means for restricting the rotation range of said rotation, and biasing spring means for urging said housing structure toward its default position at which the vertical symmetry plane thereof is substantially parallel to the longitudinal axis of said car.

40. The combination of claim 37, wherein said front-mating means further includes airflow control means situated within said substantially rectangular housing structure for blocking passage of airflow from said train-line hose to said pneumatic mating means while the two oppositely facing coupling systems of said two cars being disengaged with one another and allowing said airflow passage while said two coupling systems being engaged with one another.

* * * * *